US005947077A

United States Patent [19]

Yonezawa et al.

[11] Patent Number: 5,947,077

[45] Date of Patent: Sep. 7, 1999

[54] CONTROL DEVICE FOR CYLINDER INJECTION INTERNAL-COMBUSTION ENGINE

[75] Inventors: Shiro Yonezawa; Hirofumi Ohuchi, both of Tokyo, Japan

[73] Assignee: Mitsubishi Denki Kabushiki Kaisha, Tokyo, Japan

[21] Appl. No.: 08/957,374

[22] Filed: Oct. 24, 1997

[51] Int. Cl.[6] ..... F02B 5/00

[52] U.S. Cl. ..... 123/295; 123/305; 123/406.27; 123/406.47

[58] Field of Search ..... 123/295, 305, 123/435, 436, 406.27, 406.28, 406.47

[56] References Cited

U.S. PATENT DOCUMENTS

| | | | |
|---|---|---|---|
| 4,854,281 | 8/1989 | Hareyama et al. | 123/292 |
| 5,333,583 | 8/1994 | Matsuura | 123/295 |
| 5,483,934 | 1/1996 | Stutzenberger | 123/305 |

FOREIGN PATENT DOCUMENTS

| | | |
|---|---|---|
| 41-03-419 | 8/1991 | Germany . |
| 41-32-858 | 4/1992 | Germany . |
| 195-27-030 | 2/1996 | Germany . |
| 195-20-605 | 5/1996 | Germany . |
| 2-169834 | 6/1990 | Japan . |
| 4-187841 | 7/1992 | Japan . |
| 7-301139 | 11/1995 | Japan . |
| WO-90-04093 | 4/1990 | WIPO . |

*Primary Examiner*—Willis R. Wolfe
*Assistant Examiner*—Mahmoud M. Gimie
*Attorney, Agent, or Firm*—Sughrue, Mion, Zinn, Macpeak & Seas, PLLC

[57] ABSTRACT

A control device for a cylinder injection internal-combustion engine detects the deterioration of the combustion efficiency of the engine. The control device is equipped with: a fuel injection valve for directly injecting fuel to each cylinder in the internal-combustion engine; an ignition coil unit for driving a spark plug in each cylinder; an electronic control unit for driving each fuel injection valve and ignition coil unit according to the operational state of the internal-combustion engine; combustion state determining means for determining the combustion state of the internal-combustion engine; and combustion efficiency recovering means for recovering the combustion efficiency of the internal-combustion engine.

20 Claims, 29 Drawing Sheets

FIG. 17A CYLINDER IDENTIFICATION SIGNAL SGC

FIG. 17B CRANK ANGLE SIGNAL SGT

FIG. 17C IONIC CURRENT C

FIG. 17D WAVEFORM AREA A OF IONIC CURRENT

FIG. 23A CYLINDER IDENTIFICATION SIGNAL SGC

FIG. 23B CRANK ANGLE SIGNAL SGT

FIG. 23C KNOCKING VIBRATION

FIG. 23D PEAK HOLDING VALUE

CONTROL DEVICE FOR CYLINDER INJECTION INTERNAL-COMBUSTION ENGINE

BACKGROUND OF THE INVENTION

1. Field of the Invention

The present invention relates to a control device for a cylinder injection internal-combustion engine in which fuel is directly injected into a cylinder and, more particularly, to a control device for a cylinder injection internal-combustion engine with improved combustion efficiency of the engine in a compression stroke injection mode.

2. Description of Related Art

FIG. 27 is a block diagram showing the entire system of a control device of a typical cylinder injection internal-combustion engine.

The system shown in the drawing includes: an engine 1 which provides the main body of the internal-combustion engine and which is composed of a plurality of cylinders 1*a* through 1*d;* an inlet pipe 2 which supplies air to the cylinders 1*a* through 1*d* of the engine 1; an air cleaner 3 provided at the inlet port of the inlet pipe 2; a throttle valve 4 which is installed in the inlet pipe 2 and which adjusts an inlet air amount Q; and a surge tank 5 provided in the intake manifold of the inlet pipe 2.

The system further includes: a throttle valve lift sensor 6 which detects lift θ of the throttle valve 4; a throttle valve actuator 7 which opens and closes the throttle valve 4; a fuel injection valve 8 which directly injects fuel into the cylinders 1*a* through 1*d*; an ignition coil unit 9 provided in each of the cylinders 1*a* through 1*d*; and a spark plug 10 driven by high voltage applied by the ignition coil unit 9.

Further included in the system are: an accelerator pedal 11 operated by a driver who steps thereon; an accelerator depression sensor 12 which detects the amount of depression α of the accelerator pedal 11; a crank angle sensor 13 which is provided on a crankshaft of the engine 1 and which issues a crank angle signal SGT; a cylinder identifying sensor 14 which is provided on a cam shaft interlocked with the crankshaft and which issues a cylinder identification signal SGC; an oxygen concentration sensor 15 which detects the oxygen concentration X in the exhaust gas discharged from the engine 1; and a catalyst 16 which purifies the exhaust gas.

The sensors 6 and 13 through 15 constitute the diverse sensors for outputting operational information. Other sensors such as an airflow sensor and an inlet pipe pressure sensor for detecting the inlet air amount Q are also provided although they are not shown.

Also included in the system are: an intracylindrical pressure detecting unit 17 which detects pressure P in cylinders 1*a* through 1*d* of the engine 1 (hereinafter referred to as "intracylindrical pressure"); a knocking sensor 18 which detects knocking vibration K of the engine 1; and an ionic current detecting unit 19 which detects an ionic current C indicative of the combustion degree in the cylinders 1*a* through 1*d*.

An electronic control unit 20 is comprised of a microcomputer; it computes diverse types of control amounts according to the operational information θ, SGT, SGC, X, K, P, and C received from the various sensors 6, 13 through 15, and 18, and the detecting units 17 and 19 so as to control the engine 1 according to control signals J, G, and R based on the computed control amounts.

For instance, the electronic control unit 20 computes the target lift of the throttle valve 4 from the depression amount α of the accelerator pedal 11, and controls the throttle valve actuator 7 according to a lift control signal R, thereby conducting feedback control so that the lift θ of the throttle valve 4 coincides with the target lift.

The electronic control unit 20 computes engine speed Ne from the crank angle signal SGT, computes a target engine torque from the engine speed Ne and the depression amount α of the accelerator, computes a target fuel injection amount Fo from the engine speed Ne and the target engine torque To, and drives the fuel injection valve 8 according to the injection signal J of a driving time based on the target fuel injection amount Fo.

The electronic control unit 20 computes the ignition timings for the cylinders 1*a* through 1*d* mainly according to the crank angle signal SGT and the cylinder identification signal SGC, and causes the spark plug 10 to discharge by driving the ignition coil unit 9 in accordance with the ignition signal G.

Furthermore, the electronic control unit 20 detects the occurrence of knocking according to the knocking vibration K, and if knocking occurs, then it delays the ignition signal G to restrain the knocking.

The electronic control unit 20 also determines the combustion state of the cylinders 1*a* through 1*d* or detects the occurrence of a misfire primarily according to the intracylindrical pressure P and the ionic current C.

FIG. 28 is a block diagram detailedly showing the specific configuration of the electronic control unit 20 shown in FIG. 27.

The electronic control unit 20 shown in FIG. 28 includes: a microcomputer 21; input interfaces (I/Fs) 22 and 23 which take various types of operational information into the microcomputer 21; a power circuit 24 which supplies electric power to the microcomputer 21; and an output I/F 25 which outputs the control signals R, J, and G received from the microcomputer 21. An ignition switch 27 connects an on-car battery 26 to the electronic control unit 20 at the time of startup.

The microcomputer 21 is equipped with: a CPU 31 which mainly controls the fuel injection valve 8 and the spark plug 9 according to a predetermined program; a free-running counter 32 for detecting the rotational cycle from the crank angle signal SGT; a timer 33 for measuring time for performing diverse types of control; and an analog-to-digital converter 34 for converting an analog signal received from the input I/F 23 to a digital signal; a RAM 35 used as the work area of the CPU 31; a ROM 36 wherein an operating program for the CPU 31 has been stored; an output port 37 through which various driving control signals such as J, R, and G are output; and a common path 38 for connecting the CPU 31 with the constituent elements 32 through 37.

The input I/F 22 shapes the waveforms of the crank angle signal SGT and the cylinder identification signal SGC and supplies the shaped waveforms to the microcomputer 21 as interrupt signals. When an interrupt signal is received from the input I/F 22, the CPU 31 in the microcomputer 21 reads the value on the counter 32, computes the pulse cycle of the crank angle signal SGT from the difference between the present value and the previous value, and stores it in the RAM 35 as the value corresponding to the current engine speed Ne.

The CPU 31 also detects, at the time of the interrupt, the signal level of the cylinder identification signal SGC to detect which of a plurality of the cylinders 1*a* through 1*d* corresponds to the crank angle signal SGT detected this time.

The input I/F 23 supplies the detection signals such as the throttle valve lift θ, the intracylindrical pressure P, accelerator depression amount α, and oxygen concentration x to the CPU 31 in the microcomputer 21 via the analog-to-digital converter 34.

The output I/F 25 amplifies the diverse control signals issued from the CPU 31 via the output port 37 and supplies them to the throttle valve actuator 7, the fuel injection valve 8, the ignition coil unit 9, etc.

FIG. 29A through FIG. 29D show timing charts illustrative of the control timings of the injection signal J and the ignition signal G generated by the electronic control unit 20; it illustrates the relationship between the pulse waveforms of the cylinder identification signal SGC and the crank angle signal SGT, the fuel injection timing of the fuel injection valve 8, and the driving current of the ignition coil unit 9.

FIG. 29A shows the pulse waveform of the cylinder identification signal SGC; FIG. 29B shows the pulse waveform of the crank angle signal SGT; FIG. 29C shows the injection signal J for the fuel injection valves 8 of cylinders #1 through #4; and FIG. 29D shows ignition signal G for the ignition coil units 9 of cylinders #1 through #4.

Each pulse of the crank angle signal SGT rises, for example, at 75 degrees before reaching the top dead center (B75 degrees) corresponding to the initial energizing start timing of each cylinder, and falls at 5 degrees before reaching TDC (B5 degrees) corresponding to the initial ignition timing of each cylinder.

The cylinder identification signal SGC is issued during the compression stroke of cylinder #1 of the engine 1. Once the electronic control unit 20 recognizes the pulse of the crank angle signal SGT that corresponds to cylinder #1, it is able to tell which pulses of the crank angle signal SGT correspond to cylinders #1 through #4 of the engine 1.

Since the rising edge of the crank angle signal SGT indicates B75 degrees of a corresponding cylinder and the falling edge indicates B5 degrees of the corresponding cylinder, the electronic control unit 20 detects those edges indicative of B75 degrees and B5 degrees by the interrupt function of the microcomputer 21 to use them as the reference positions of the fuel injection timing and the ignition timing.

In the case of the cylinder injection internalcombustion engine, the combustion state of the engine 1 depends on the falling timing, i.e. the fuel injection end timing, of the injection signal J and the falling timing of the ignition signal G, i.e. the ignition timing.

Normally, when the fuel injection end timing and the ignition timing have been decided to ensure optimum fuel consumption rate, the fuel injection end timing is controlled so that it is slightly delayed from the rising edge B75 degrees (e.g. approximately B60 degrees) of the crank angle signal SGT, while the ignition timing is controlled so that it is slightly advanced (approximately B15 degrees) from the falling edge B5 degrees of the crank angle signal SGT.

The CPU 31 in the electronic control unit 20 determines to which cylinder the crank angle signal SGT corresponds in accordance with the cylinder identification signal SGC, and applies the injection signal J matched to the fuel injection timing so as to inject the predetermined amount Fo of fuel to the fuel injection valve 8 of the cylinder under the control.

The CPU 31 also issues the ignition signal G matched to the ignition timing to the ignition coil unit 9 of the cylinder under the control. This causes the ignition coil unit 9 to apply the high voltage obtained by amplifying battery voltage to the spark plug 10 to ignite and burn the fuel at the computed control timing.

Thus, the fuel is directly injected into the cylinders 1*a* through 1*d*, and the injected fuel burns to run the engine 1.

The specific operation of the control device of a conventional cylinder injection internal-combustion engine configured as shown in FIG. 27 and FIG. 28 will now be described with reference to the timing charts of FIG. 29A through FIG. 29D and the schematic representations and the characteristic charts of FIG. 30 through FIG. 36.

FIG. 30 illustrates the relationship between the fuel injection mode and the engine speed Ne and the target engine torque To. The hatched area wherein the target engine torque To is ToA or less and the engine speed Ne is NeB or less indicates that the engine 1 consumes a smaller amount of fuel per cycle.

Hence, in the aforesaid area, the driving time, i.e. the pulse width of the injection signal J, of the fuel injection valve 8 can be set to a smaller value, and the compression stroke injection mode in which the fuel is injected during the compression stroke of the engine 1 is implemented. In the compression stroke injection mode, the combustion takes place locally in the cylinders. 1*a* to 1*d*, namely, in the vicinity of the spark plugs 10, requiring less fuel relative to a cylinder volume. This provides an advantage in that better economy and easier control of the air/fuel ratio for combustion can be achieved.

FIG. 31 is a characteristic chart illustrative of the relationship between the air/fuel ratio (A/F) and the engine-generated torque Te; the solid line denotes the characteristic curve observed in the compression stroke injection mode, and the chain line denotes the characteristic curve observed in the suction stroke injection mode.

As is obvious from FIG. 31, the compression stroke injection enables the engine-generated torque Te to be controlled according to the air/fuel ratio A/F even when the stoichiometric air/fuel ratio (14.7) is set to a value for a leaner mixture.

Conversely, in FIG. 30, when the target engine torque To exceeds ToA or when the engine speed Ne exceeds NeB, the injection of the predetermined fuel amount Fo cannot be completed in the compression stroke. For this reason, the suction stroke injection is performed so that the fuel is injected during the period from the suction stroke to the compression stroke. A comparative reference values ToA and NeB may be fixed values which have been preset as necessary or arbitrary variables.

In the suction stroke injection mode, the same fuel injection and combustion state as those observed in an engine, not shown, wherein fuel is injected in the vicinity of the inlet port will be obtained, so that combustion is implemented by using all the cylinder volume, providing an advantage of a higher engine output.

FIG. 32 and FIG. 33 are schematic representatives illustrative of the combustion states generated by the different fuel injection modes mentioned above; FIG. 32 schematically shows the combustion state observed in the compression stroke injection mode, and FIG. 33 schematically shows the combustion state observed in the suction stroke injection mode.

The schematic representatives show a combustion chamber 40 in a cylinder of the engine 1, an intake valve 41 which communicates the combustion chamber 40 to the surge tank 5, an exhaust valve 42 which communicates the combustion chamber 40 to an exhaust pipe, a combustion area 50 wherein combustion takes place in the compression stroke injection mode, and a combustion area 51 wherein combustion takes place in the suction stroke injection mode.

As shown in FIG. 32, in the compression stroke injection mode, a small amount of fuel is injected into the combustion chamber 40, the fuel is gathered in the vicinity of the spark plug 10, then combustion takes place only in the area around the spark plug 10 in the form of a layer of a concentrated mixture (see the combustion area 50).

At this time, even when the same inlet air amount Q of the engine 1 is used, the generated torque Te of the engine 1 changes depending on the amount of fuel injected in the vicinity of the spark plug 10; hence, the fuel injection amount Fo is changed according to the target engine torque To.

In the suction stroke injection mode, the fuel is injected during the suction stroke and dispersed in the entire area inside a cylinder, so that the combustion takes place in the entire area inside the cylinder as shown in FIG. 33 (see the combustion area 51).

Generally, if the fuel injection amount Fo is increased, whereas the air/fuel ratio A/F is set in the vicinity of the stoichiometric air/fuel ratio (14.7) which enables combustion, then the suction stroke injection mode shown in FIG. 33 is employed because the injection of the fuel cannot be completed during the compression stroke and the fuel cannot be sufficiently dispersed in a cylinder in the compression stroke injection mode.

In the compression stroke injection mode shown in FIG. 32, the fuel injection timing based on the injection signal J and the ignition timing based on the ignition signal G greatly influence the combustion efficiency; if the time from fuel injection to ignition is too short, then the fuel does not reach the area near the spark plug 10 at the time of ignition, preventing optimum combustion from taking place.

Conversely, if the time from fuel injection to ignition is too long, then the fuel is ignited after passing the spark plug 10, also preventing optimum combustion from taking place.

Thus, appropriate fuel injection timing and ignition timing are determined as described below although they vary according to parameters such as the engine speed Ne and the target engine torque To.

FIG. 34 through FIG. 36 are characteristic charts illustrative of the combustion efficiency of the engine 1 when the fuel injection timing, i.e. the injection end timing, and the ignition timing are changed under a certain operating condition; the axis of abscissa indicates the injection end timing, i.e. the position based on the crank angle, the axis of ordinate indicates the ignition timing, i.e. the position based on the crank angle, and W denotes the point at which the fuel consumption rate is the highest (e.g. the injection end timing is B60 degrees and the ignition timing is B15 degrees).

FIG. 34 shows the increase and decrease in the exhaust amount of THC such as HC gas in relation to the injection end timing and the ignition timing; the curves indicate the transition of the exhaust amount of THC. In FIG. 34, the exhaust amount of THC is the smallest in the area enclosed by curve a at the bottom center; the exhaust amount of THC increases as the injection end timing and the ignition timing shift from the area enclosed by curve a into the areas enclosed by the outer curves.

FIG. 35 shows the increase and decrease in the frequency of misfires in relation to the injection end timing and the ignition timing. In FIG. 35, the frequency of misfires is the lowest in the area on the left of curve b at the center; hence, the frequency of misfires increases as the injection end timing and the ignition timing shift from the area on the left of curve b into the area defined by the curves at the bottom right.

FIG. 36 shows the fuel consumption rate in relation to the injection end timing and the ignition timing; the fuel consumption rate is the highest in the area enclosed by curve c at the center. This means that the fuel consumption rate becomes worse toward the areas defined by the curves away from curve c.

The fuel injection timing and the ignition timing are determined, taking the combustion efficiency of the engine 1 described above into account. The determining condition is, for example, that the THC exhaust amount and the frequency of misfires are predetermined values or less and the fuel consumption rate is the maximum point W.

Generally, the combustion in the suction stroke injection mode shown in FIG. 33 uses the entire interior space of a cylinder as previously described; hence, the combustion efficiency of the engine 1 is affected less by the fuel injection timing.

In the combustion carried out in the compression stroke injection mode shown in FIG. 32, however, both fuel injection timing and ignition timing can be the factors affecting the combustion efficiency of the engine 1.

Thus, in the compression stroke injection mode, the combustion takes place only in the layer of the concentrated mixture near the spark plug 10; however, not all fuel burns completely. Hence, the mixture at the central portion of the mixture layer is rich and exhibits good combustion, whereas the mixture at the outer peripheral portion of the mixture layer is lean and may fail to burn completely or may not burn at all.

Such incomplete combustion components or unburnt components will be discharged through an exhaust port to open air or remain in cylinders 1*a* through 1*d* and adhere to pistons or the spark plugs 10. This means that some fuel components are apt to adhere to the pistons or the spark plugs 10 in the compression stroke injection mode.

As more incomplete combustion components or unburnt components adhere to the spark plugs 10, the insulation resistance of the spark plugs 10 deteriorates, preventing proper sparking from the central electrodes of the spark plugs 10 to the grounding electrodes. As a result, a part of all spark is easily attracted to a portion where the resistance is lower than that of the grounding electrodes of the spark plugs 10.

Thus, when the insulation resistance of the spark plugs 10 lowers, the ignition energy thereof accordingly decreases, leading to the occurrence of a misfire due to a fuel ignition failure.

In addition, as more misfires of the engine 1 occur, unburnt gas is discharged directly to the open air, deteriorating the exhaust gas components, and the burning energy of the fuel also deteriorates with a consequent decrease in the output torque of the engine 1, so that the rotational torque in the engine 1 fluctuates, resulting in deteriorated drivability.

Thus, the conventional control device for a cylinder injection internal-combustion engine has a shortcoming in that incomplete combustion may take place in the outer peripheral portion of the mixture layer near the spark plugs 10 and incompletely burnt components or unburnt components may adhere to the pistons or the spark plugs 10 in the cylinders 1*a* through 1*d*.

There has been a problem in that the deteriorated insulation resistance due to the incompletely burnt components or unburnt components adhering to the spark plugs 10 causes a part or all of the sparks from the central electrodes of the spark plugs 10 to the grounding electrodes thereof to be easily drawn to a portion where the resistance is lower than that of the grounding electrodes, and the ignition energy decreases, leading to the occurrence of a misfire.

There has been another problem in that, as the frequency of misfires of the engine 1 increases, the unburnt gas is discharged directly through the exhaust port; hence, the exhaust gas components deteriorate and the burning energy of the fuel decreases. As a result, the output torque of the engine drops and the rotational torque of the engine 1 varies, leading to deteriorated drivability.

SUMMARY OF THE INVENTION

The present invention has been made with a view toward solving the problems described above, and it is an object of the invention to provide a control device for a cylinder injection internal-combustion engine which is capable of detecting the deterioration in the combustion state of the engine and of restoring a proper combustion state.

It is another object of the present invention to provide a control device for a cylinder injection internal-combustion engine which is capable of preventing the combustion efficiency of the engine from deteriorating.

To these ends, according to one aspect of the present invention, there is provided a control device for a cylinder injection internal-combustion engine equipped with: a fuel injection valve for directly injecting fuel into each of the cylinders of the internal-combustion engine; an ignition coil unit for driving the spark plug in each of the cylinders; an electronic control unit for driving the fuel injection valves and the ignition coil units according to the operational state of the internal-combustion engine; combustion state determining means for determining the combustion state of the internal-combustion engine; and combustion efficiency recovering means for recovering the combustion efficiency of the internal-combustion engine if it is determined that the combustion state has been deteriorated. With this arrangement, the combustion efficiency can be restored automatically and effectively.

In a preferred form of the present invention, the combustion efficiency recovering means of the control device for a cylinder injection internal-combustion engine is constituted by an injection mode changing means for changing the fuel injection mode from the compression stroke injection mode to the suction stroke injection mode.

For instance, when misfires occur more frequently, the deterioration of the combustion state is detected and the fuel injection is changed to the suction stroke injection mode, thereby permitting the insulation resistance of a spark plug to be restored and the frequency of misfires to be decreased so as to improve the combustion efficiency. Thus, the ignition energy of the spark plug is enhanced and the combustion efficiency is recovered, i.e. the frequency of misfires is lowered, thereby maintaining a good combustion state of the internal-combustion engine 1. Moreover, since the combustion torque of the internal-combustion engine is not deteriorated, a drop in the output torque can be restrained and stable revolution of the internal-combustion engine can be accomplished, thus enabling good drivability to be maintained.

In another preferred form of the present invention, the injection mode changing means of the control device for a cylinder injection internal-combustion engine is designed to set the fuel injection back to the compression stroke injection mode which permits a better fuel consumption rate when a normal combustion state has been restored, thereby ensuring improved economy.

At this time, since the combustion state has been corrected, harmful components of the exhaust gas can be restrained more than before the recovering procedure was carried out even after the normal state has been restored. Furthermore, since the combustion torque of the internal-combustion engine 1 is stable, the drivability in the compression stroke injection mode can be recovered.

In a further preferred form of the present invention, the combustion state determining means of the control device of the control device for a cylinder injection internal-combustion engine determines the combustion state again after setting the fuel injection back to the compression stroke injection mode. If the deterioration of the combustion state is detected again, then the injection mode changing means switches the injection mode to the suction stroke injection mode again, or if no deterioration of the combustion state is detected any more, then the compression stroke injection mode is maintained. Thus, the exhaust gas and the drivability can be maintained in good states and the economy can be improved with a minimum of fuel consumption without the need for implementing wasteful combustion efficiency recovering processing.

In a preferred form of the present invention, the combustion state determining means of the control device for a cylinder injection internal-combustion engine determines that the combustion state has deteriorated if the frequency of misfires has exceeded a first predetermined value in the compression stroke injection mode, and it determines that the combustion state has deteriorated again if the frequency of misfires has exceeded a second predetermined value which is smaller than the first predetermined value within a predetermined time from the moment the injection mode was set from the suction stroke injection mode back to the compression stroke injection mode. This feature ensures that the normal combustion efficiency is recovered.

In a further preferred form of the present invention, the combustion efficiency recovering means of the control device for a cylinder injection internal-combustion engine is composed of an air/fuel ratio changing means for changing the air/fuel ratio of the internal-combustion engine to a rich mode.

For instance, if the frequency of misfires increases, it is determined that the combustion state has deteriorated, and the air/fuel ratio is changed to enrich the mixture. This increases the amount of combustible mixture around a spark plug, so that the combustion is promoted and the frequency of misfires is decreased, thus improving the combustion efficiency. Moreover, since the compression stroke injection mode wherein the air/fuel ratio is set in the lean mode is maintained at the time of restoring the normal combustion state, economical operation with less fuel consumption can be maintained.

In a further preferred form of the present invention, the air/fuel ratio changing means of the control device for a cylinder injection internal-combustion engine changes the air/fuel ratio to enrich the mixture only by a predetermined amount, and it changes the air/fuel ratio again to further enrich the mixture by the predetermined amount if the combustion state deteriorates again within a predetermined time after the air/fuel ratio has been changed. This makes it possible to securely restore the combustion efficiency while restraining the fuel consumption.

In a further preferred form of the present invention, the air/fuel ratio changing means of the control device for a cylinder injection internal-combustion engine sets the air/fuel ratio back to the lean mode as soon as the normal combustion state is recovered, thus assuring improved economy. Since the combustion state has been corrected, harmful components of the exhaust gas can be restrained more than before the recovering procedure was carried out even after the normal state has been restored. Furthermore, since the combustion torque of the internal-combustion engine 1 is stable, the drivability can be recovered.

In a still further preferred form of the present invention, the combustion state determining means of the control device for a cylinder injection internal-combustion engine checks the combustion state again after setting the air-fuel ratio back to the lean mode, and if it is determined that the combustion state has deteriorated again, then the air/fuel ratio changing means changes the air/fuel ratio to the rich mode again, or if no deterioration of the combustion state is recognized any more, then it maintains the air/fuel ratio in the lean mode. Hence, good exhaust gas and drivability conditions can be maintained without the need for executing wasteful combustion efficiency recovering procedure, and economy can be improved at the same time.

In a preferred form of the present invention, the combustion state determining means of the control device for a cylinder injection internal-combustion engine determines that the combustion state has deteriorated if the frequency of misfires has exceeded a first predetermined value in the lean mode of the air/fuel ratio, and it determines that the combustion state has deteriorated again if the frequency of misfires has exceeded a second predetermined value which is smaller than the first predetermined value within a predetermined time from the moment the rich mode was set back to the lean mode.

In a preferred form of the present invention, the combustion efficiency recovering means of the control device for a cylinder injection internal-combustion engine is composed of an ignition control changing means for applying an ignition signal also to the ignition coil unit of a cylinder in addition to the cylinder under ignition control.

For instance, if the frequency of misfires increases, the deterioration of the combustion state is determined and voltage is applied to a spark plug at a timing in addition to a regular ignition timing. This makes it possible to restore the normal insulation resistance of the spark plug and the frequency of misfires can be lowered, leading to improved combustion efficiency. The normal combustion state can be restored in the compression stroke injection mode with less fuel consumption because the recovery requires only the extra application of high voltage to the spark plug, eliminating the need for changing the air/fuel ratio.

In a further preferred form of the present invention, the ignition control changing means of the control device for a cylinder injection internal-combustion engine resets the ignition signal to its normal state when the normal combustion state has been restored so as to stop the signal which is no longer necessary, thereby permitting improved economy. At this time, since the normal combustion state has been restored, harmful components of the exhaust gas can be restrained more than before the recovering procedure was carried out even after the normal ignition control state has been restored. Furthermore, since the combustion torque of the internal-combustion engine is stable, the drivability can be recovered.

In a still further preferred form of the present invention, the combustion state determining means of the control device for a cylinder injection internal-combustion engine checks the combustion state again after resetting the ignition signal to the normal mode, and if it is determined that the combustion state has deteriorated again, then the ignition control changing means applies the ignition signal again to the ignition coil unit of a cylinder in addition to the cylinder under the ignition control, or if no deterioration of the combustion state is recognized any more, then it maintains the ignition signal in the normal mode. Hence, good exhaust gas and drivability conditions can be maintained without the need for issuing a wasteful ignition signal, and economy can be improved at the same time.

In a preferred form of the present invention, the combustion state determining means of the control device for a cylinder injection internal-combustion engine determines that the combustion state has deteriorated if the frequency of misfires has exceeded a first predetermined value in the normal ignition signal state, and it determines that the combustion state has deteriorated again if the frequency of misfires has exceeded a second predetermined value which is smaller than the first predetermined value within a predetermined time from the moment the ignition signal was set back to the normal state.

In a preferred form of the present invention, the combustion efficiency recovering means of the control device for a cylinder injection internal-combustion engine is constituted by a control timing changing means for changing at least one of the fuel injection timing based on an injection signal and the ignition timing based on an ignition signal.

With this arrangement, the dropped insulation resistance of a spark plug is corrected to recover the combustion efficiency, i.e. to reduce the frequency of misfires, when the combustion efficiency deteriorates due to, for example, an increase in the frequency of misfires. In addition, since the combustion efficiency is restored by changing the operational state of the internal-combustion engine, the air/fuel ratio need not be changed, the normal combustion state can be restored in the compression stroke injection mode in which less fuel is consumed, and no additional control device which would lead to higher cost is required, thus permitting the recovery of the combustion efficiency by an inexpensive arrangement.

In a preferred form of the present invention, the control timing changing means of the control device for a cylinder injection internal-combustion engine sets the injection signal and the ignition signal back to the normal states thereof when the normal combustion state has been restored, thus accomplishing improved economy.

At this time, since the normal combustion state has been restored, the amount of discharged harmful components of the exhaust gas can be restrained more than before the recovering procedure was carried out even after the normal control state has been restored. Furthermore, since the combustion torque of the internal-combustion engine is stable, the drivability can be recovered.

In a preferred form of the present invention, the combustion state determining means of the control device for a cylinder injection internal-combustion engine judges the combustion state again after resetting the control timing back to the normal state, and if it is determined that the combustion state has been deteriorated, then the control timing changing means changes the control timing again, or if no deterioration of the combustion state is recognized any more, then the control timing changing means maintains the control timing in the normal state. Thus, the exhaust gas and the drivability can be maintained in good states and the economy can be improved without the need for implementing wasteful combustion efficiency recovering processing.

In a further preferred form of the present invention, the combustion state determining means of the control device for a cylinder injection internal-combustion engine determines that the combustion state has deteriorated if the frequency of misfires has exceeded a first predetermined value in the normal control timing state, and it determines that the combustion state has deteriorated again if the frequency of misfires has exceeded a second predetermined value which is smaller than the first predetermined value within a predetermined time from the moment the control timing was reset to the normal state.

In a preferred form of the present invention, the control device for a cylinder injection internal-combustion engine is equipped with at least one of a rotational change detecting means, an ionic current detecting unit for detecting ionic current from each cylinder, an air/fuel ratio difference detecting means for detecting the difference between an actual air/fuel ratio and a target air/fuel ratio according to the oxygen concentration of exhaust gas discharged from each cylinder, and an intracylindrical pressure detecting unit for detecting the intracylindrical pressure of each cylinder; and a combustion state determining means determines that the combustion state has deteriorated when it detects at least one of a rotational fluctuation of a predetermined value or more, an ionic current of a predetermined value or less, an air/fuel ratio difference of a predetermined value or more, and an intracylindrical pressure of a predetermined value or more.

According to another aspect of the present invention, there is provided a control device for a cylinder injection internal-combustion engine equipped with: a fuel injection valve for directly injecting fuel into a cylinder of the internal-combustion engine; an ignition coil unit for driving a spark plug in a cylinder; an electronic control unit for driving each fuel injection valve and the ignition coil unit according to the operational state of the internal-combustion engine; elapsed time determining means for determining whether the operating in the compression stroke injection mode has lasted for a predetermined time during which the deterioration of the combustion state can happen; and combustion efficiency recovering means for restoring the combustion efficiency of the internal-combustion engine; wherein the combustion efficiency recovering means is constituted at least by: injection mode changing means for changing the injection state of fuel from the compression stroke injection mode to the suction stroke injection mode; air/fuel ratio changing means for changing the air/fuel ratio of the internal-combustion engine to the rich mode; ignition control changing means for applying an ignition signal also to an ignition coil unit of a cylinder in addition to a cylinder under ignition control; and control timing changing means for changing at least one of the fuel injection timing based on an injection signal and the ignition timing based on an ignition signal.

With this arrangement, if the operation in the compression stroke injection mode wherein the combustion efficiency deteriorates is continued for a predetermined time, then the operation can be performed under a condition wherein the combustion efficiency is improved by applying the combustion efficiency recovering means. Moreover, since the combustion efficiency recovering means is applied depending on the operating time in the compression stroke injection mode, the need for the combustion state determining means is obviated, permitting a simplified configuration of the control means, and the combustion state can be made always good before it deteriorates.

DESCRIPTION OF THE PREFERRED EMBODIMENTS

First Embodiment

A first embodiment of the present invention will be described in conjunction with the accompanying drawings.

Figure 27:
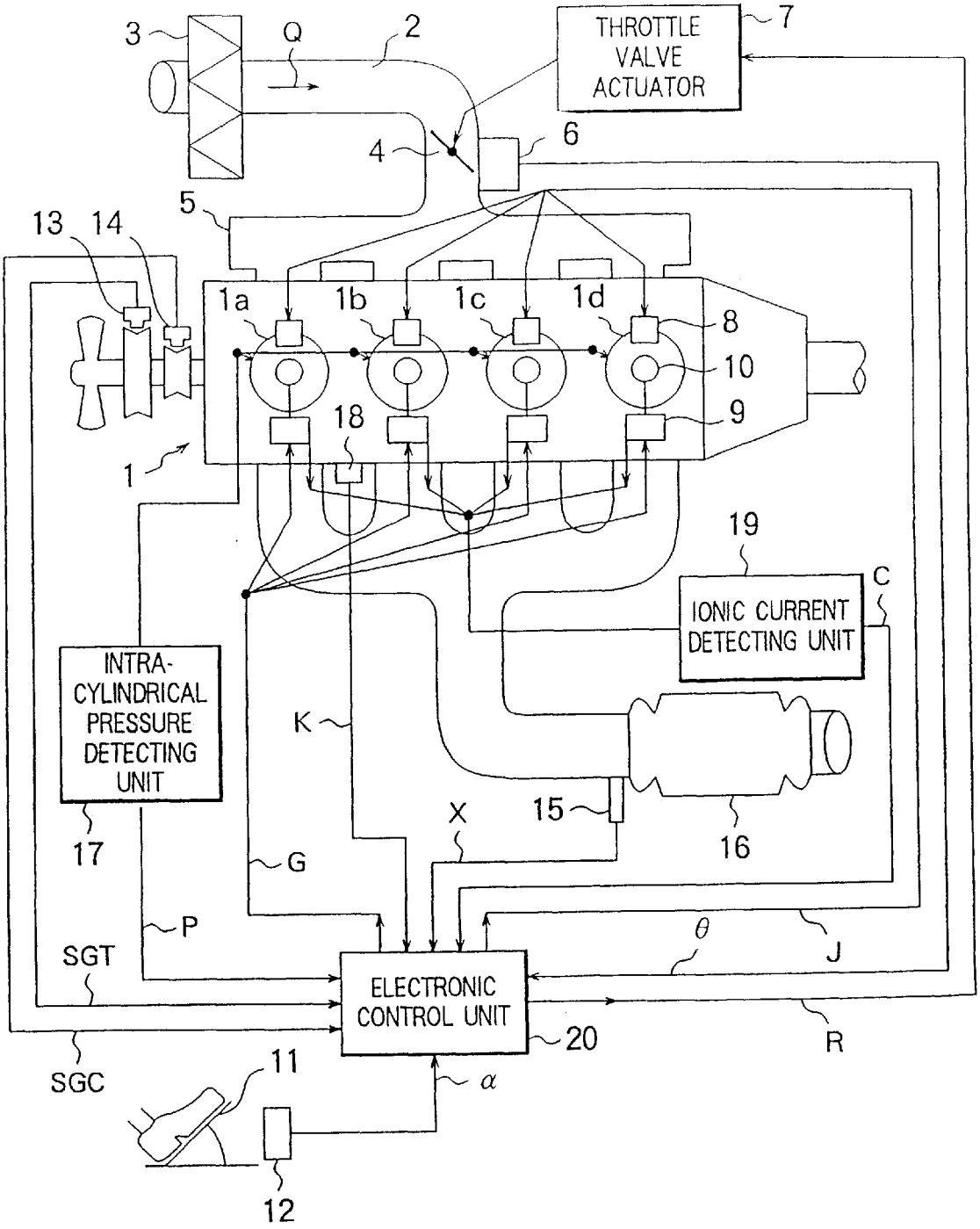
FIG. 27 is a block diagram showing the entire system of a control device of a typical cylinder injection internal-combustion engine.

The composition and the normal control operation of a system in accordance with the first embodiment of the present invention are the same as those described previously with reference to FIG. 27 and FIG. 28; hence, the description thereof will be omitted.

In the first embodiment, a CPU 31 in an electronic control unit 20 is equipped with a combustion state determining means and a combustion efficiency recovering means or an injection mode changing means for restoring the combustion efficiency when it is determined that the combustion state has deteriorated.

Referring first to the timing charts shown in FIGS. 1A through 1C and the flowchart shown in FIG. 2, the processing for determining the combustion state, that is, detecting misfires, of an engine 1 according to the first embodiment of the present invention will be described.

Figures 1A, 1B, 1C:
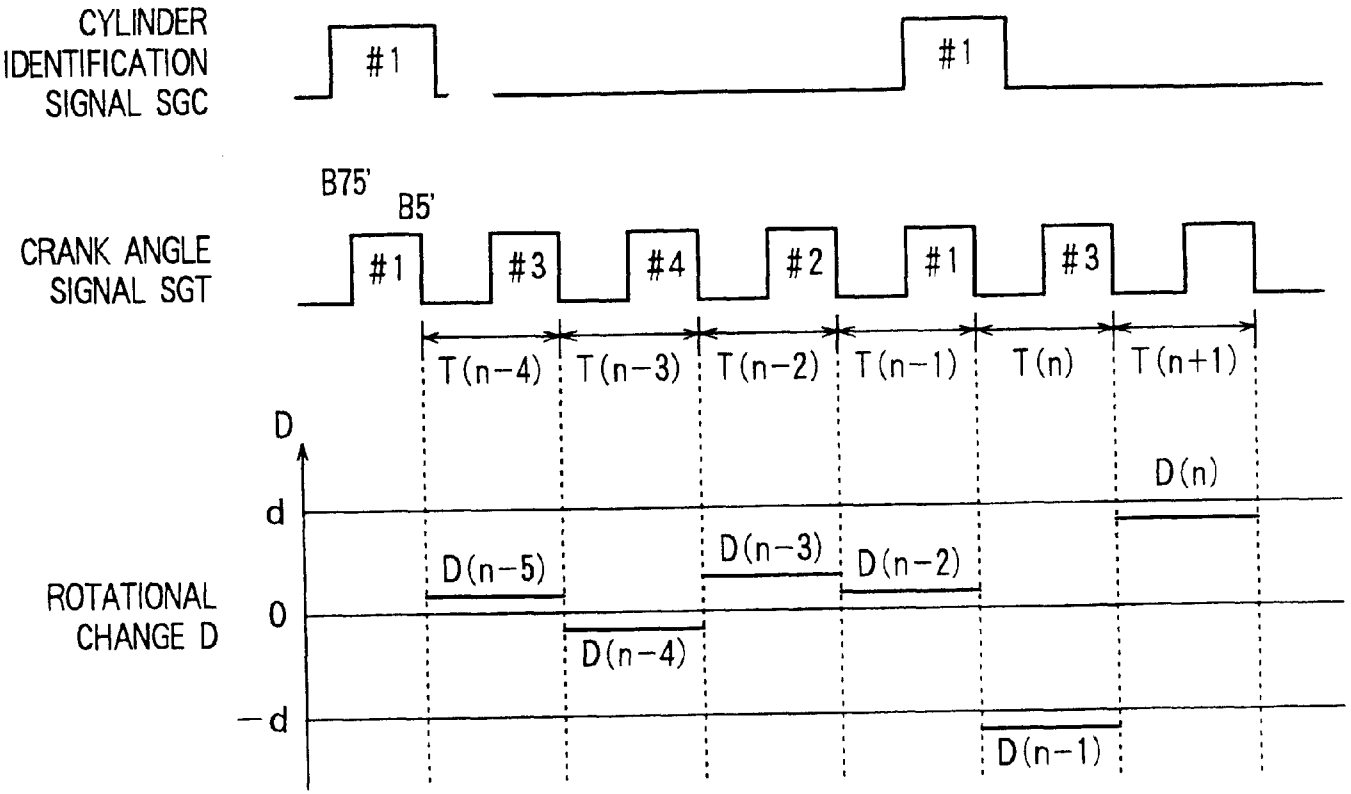
FIG. 1A through FIG. 1C are timing charts illustrative of a misfire determination processing operation based on the rotational variation according to a first embodiment of the present invention.

FIGS. 1A through 1C show the timing chart illustrative of the processing operation for detecting a misfire in the engine 1 according to a rational change in the engine 1 (see FIG. 27) in the first embodiment of the present invention.

Figures 29A, 29B, 29C, 29D:
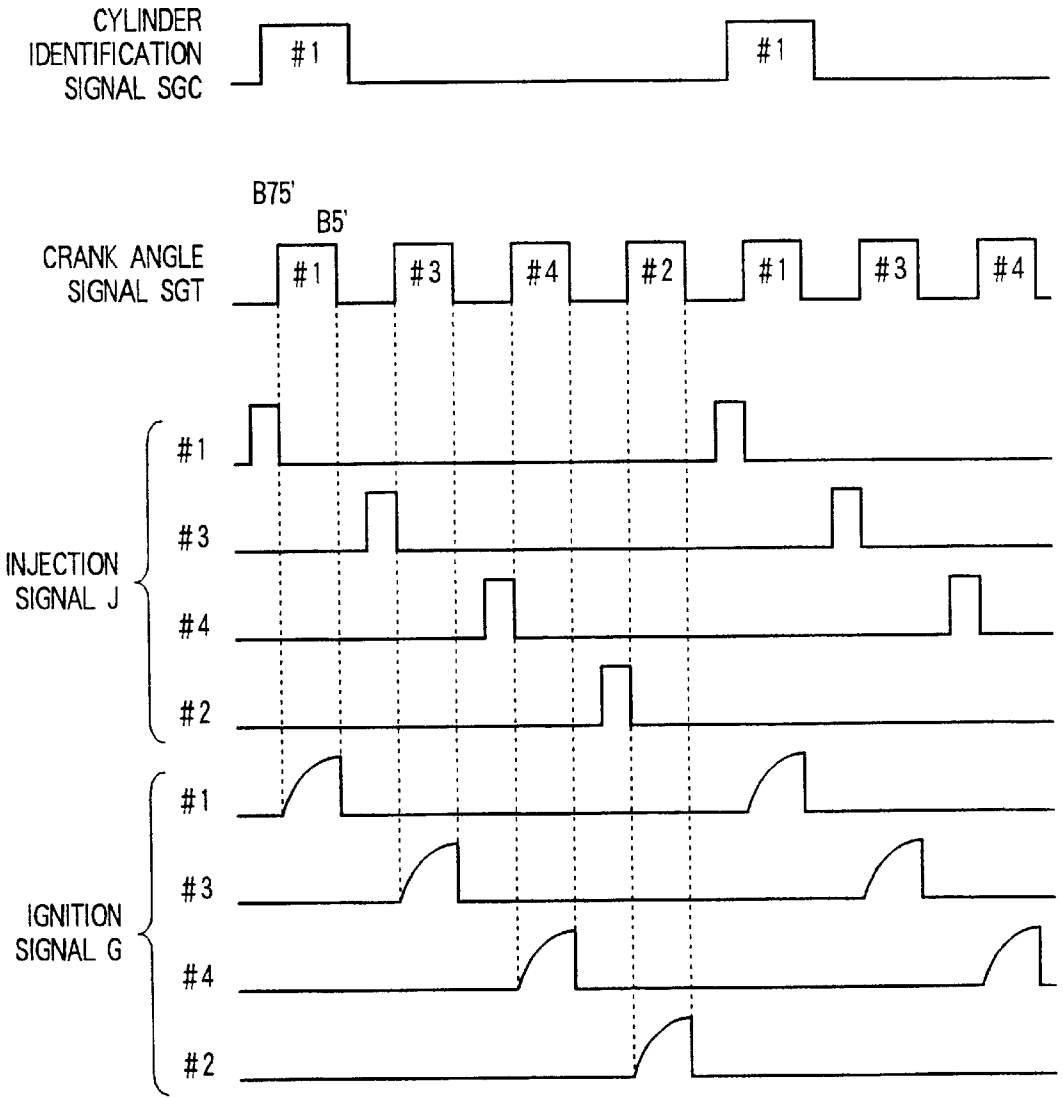
FIG. 29A through FIG. 29D are timing charts showing typical control of an injection signal indicative of the injection timing for a fuel injection valve and an ignition signal indicative of the ignition timing for a spark plug in relation to a cylinder identification signal and a crank angle signal.
Figure 30:
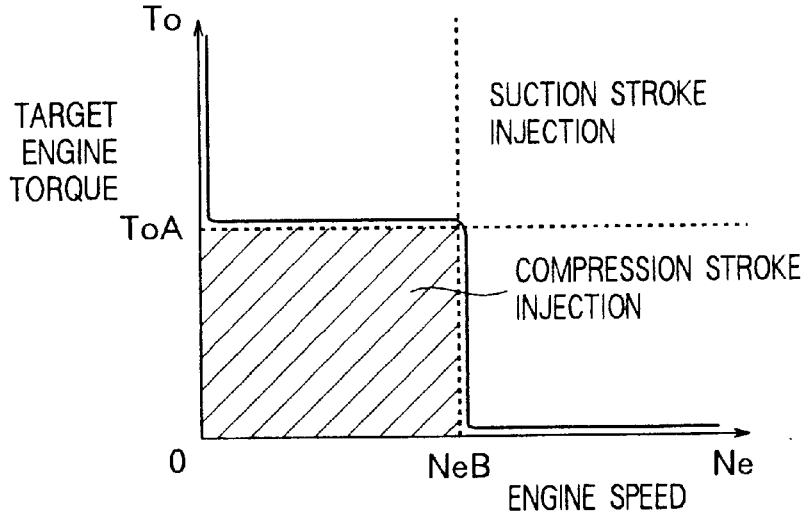
FIG. 30 is a schematic representation showing typical control of the fuel injection mode in relation to an engine speed and a target engine torque.
Figure 31:
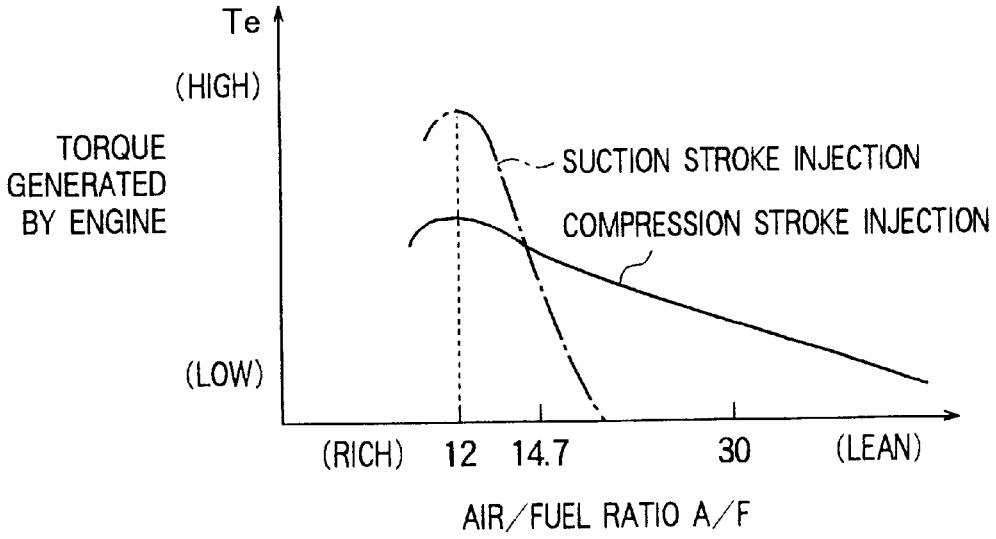
FIG. 31 is a typical characteristic chart illustrative of the relationship between the air/fuel ratio and the engine torque in the suction stroke injection mode and the compression stroke injection mode.
Figure 32:
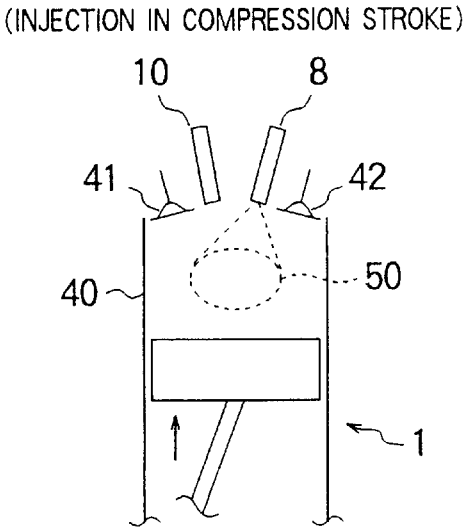
FIG. 32 is a schematic representation showing a typical combustion state in the compression stroke injection mode.
Figure 33:
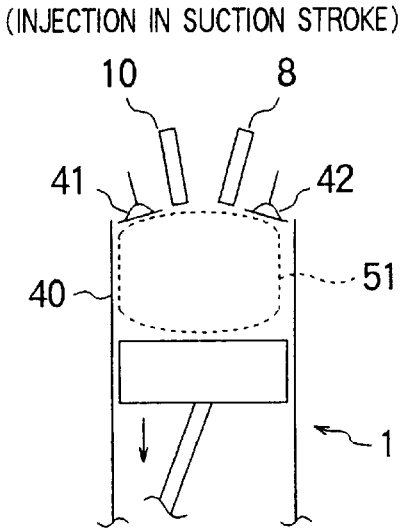
FIG. 33 is a schematic representation showing a typical combustion state in the suction stroke injection mode.

FIG. 1A and FIG. 1B show the cylinder identification signal SGC and the crank angle signal SGT that are identical to those previously described with reference to FIG. 29; T(i)(i=n, n−1, n−2, . . . ) indicates the cycle for each timing of the crank angle signal SGT.

FIG. 1C shows rotational change D in the engine 1; and −d denotes a predetermined value which provides the misfire judgment reference.

Rotational change D(i)(i=n, n−1, n−2, . . . ) for each arithmetic operation timing is given by expression (1) below according to the degree of the difference between the crank angle cycles T(i) and T(i−1) with respect to the crank angle cycle T(i).

$$D(i)=\{T(i-1)-T(i)\}/T(i) \quad (1)$$

Figure 2:
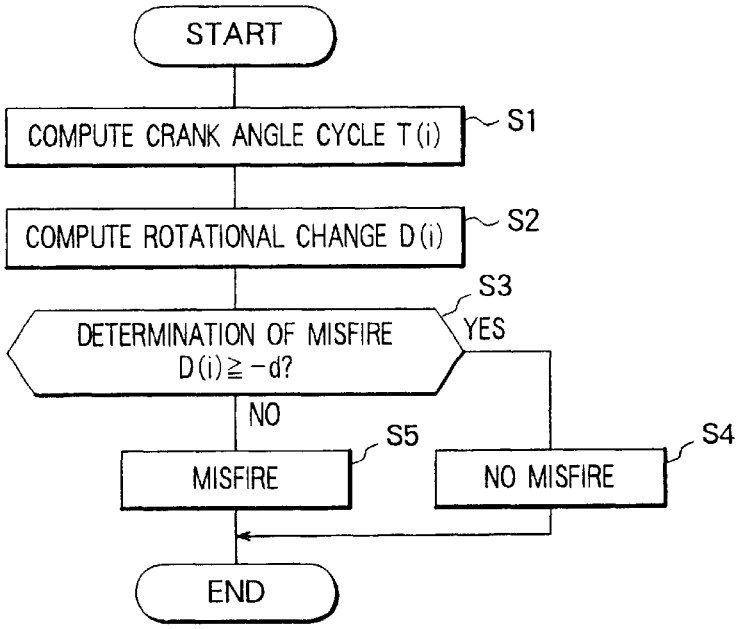
FIG. 2 is a flowchart illustrative of a misfire determination processing operation based on the rotational variation according to a first embodiment of the present invention.

FIG. 2 shows the flowchart illustrative of the processing of determining a misfire by a cyclic change in the crank angle signal SGT; interrupt processing is implemented at B5 degrees of the falling edge of the crank angle signal SGT.

Figure 28:
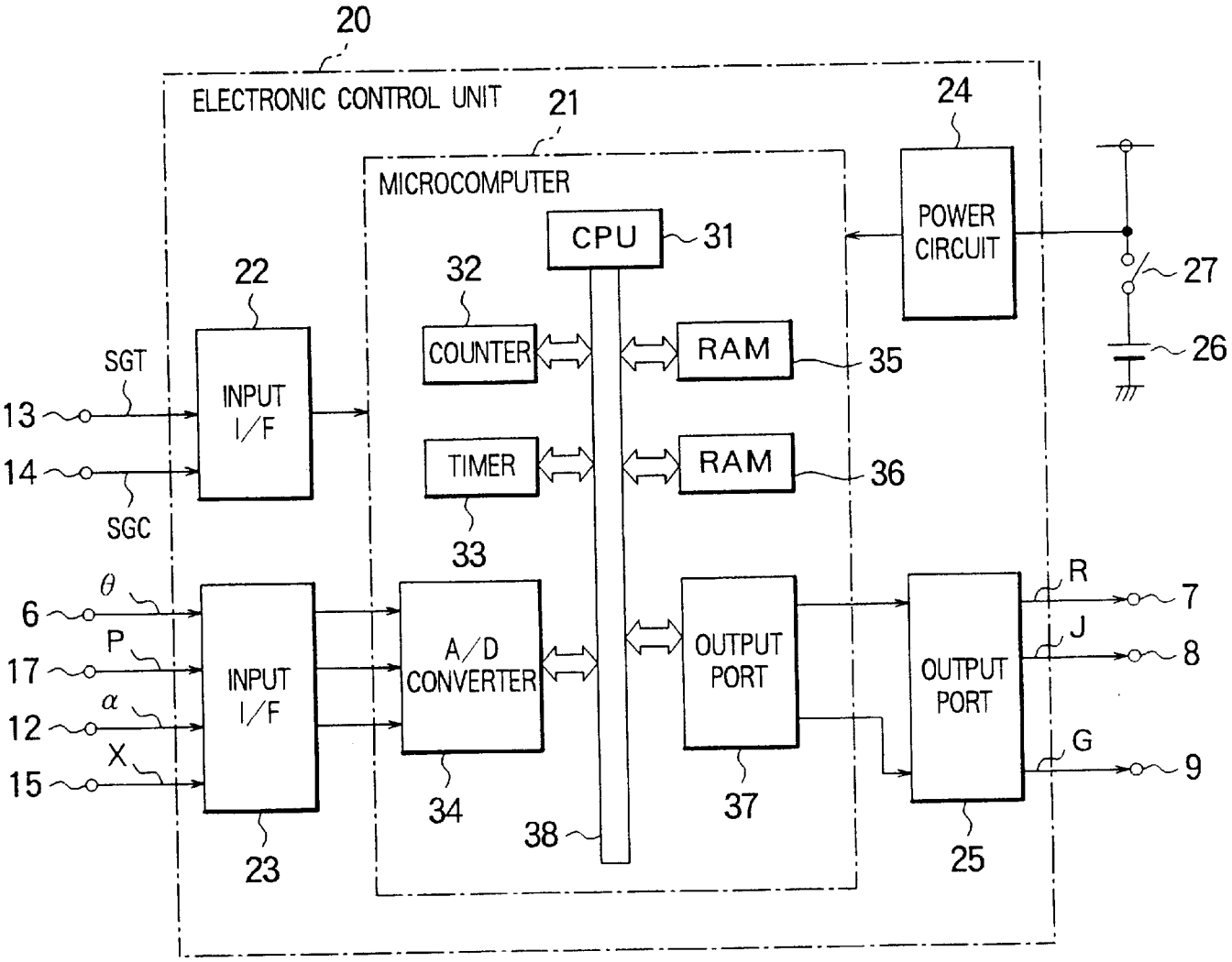
FIG. 28 is a block diagram specifically showing the functional configuration of an electronic control unit in FIG. 27.

The CPU 31 of the electronic control unit 20 shown in FIG. 28 computes the cycle T(i) of the crank angle signal SGT according to the times when the present and previous interrupts occurred at the falling edge of the crank angle signal SGT (step S1).

To be more specific, the time when an edge of the crank angle signal SGT is sensed is detected by a counter 32 and the detected time is stored in a RAM 35. The difference between the time when the previous falling edge was detected and the time when the present falling edge has been detected is computed and the computed result is stored in the RAM 35 as the cycle T(i).

Normally, the engine 1 generates combustion torque by igniting and burning fuel; the engine 1 is driven by the combustion torque which is generated in succession.

If a certain cylinder fails to have normal combustion due to some reason with a consequent misfire, then no combustion torque is generated, and the revolution of the engine 1 drops until the next combustion torque is generated, resulting in an extended cycle T(i) of the crank angle signal SGT.

Thus, based on expression (1) above, the rotational change D of the engine 1 is computed from the change in the cycle T(i), that is, the degree of the difference in cycle {T(i−1)−T(i)} in relation to the cycle T(i) (step S2).

For instance, taking "i" in expression (1) as "n," the rotational change D (n) is computed using the previous crank angle cycle T(n−1) stored in the RAM 35 in a microcomputer 21.

Subsequently, the occurrence of a misfire is judged according to whether the computed rotational change D is the predetermined value, namely, −d, or more (step S3).

If D(i)≧−d, i.e. the determination result is YES, then the CPU determines that engine speed Ne has not dropped to a level at which a misfire occurs and that no misfire has occurred (step S4); or if D(i)<−d, i.e. the determination result is NO, then the CPU decides that the engine speed Ne has sufficiently dropped and that a misfire has taken place (step S5), then exits from the interrupt routine of FIG. 2.

Figure 3:
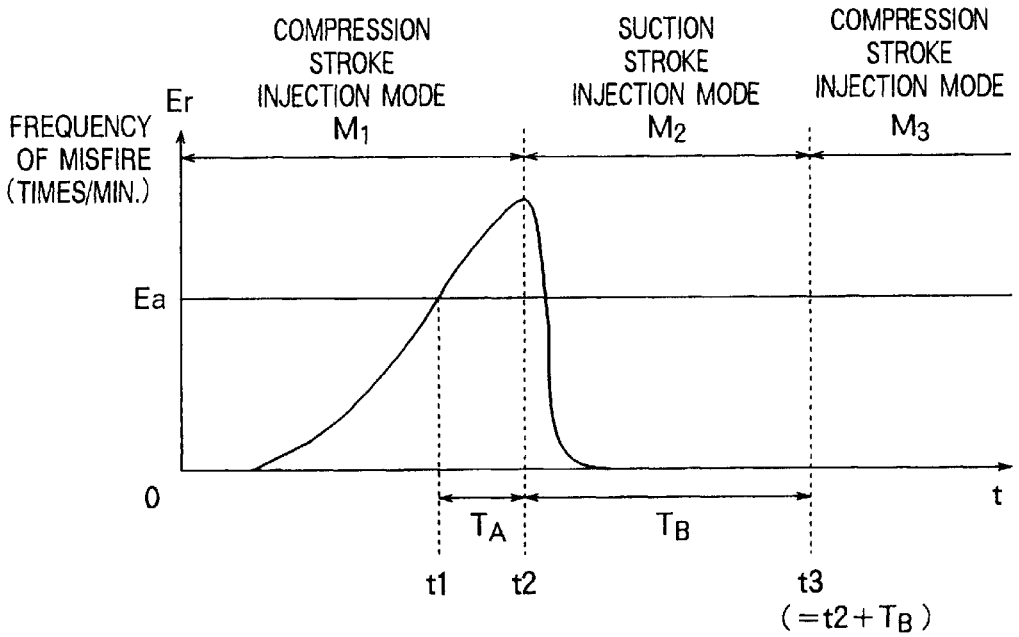
FIG. 3 is a schematic representation illustrating the processing for changing the fuel injection mode according to the first embodiment of the present invention.

FIG. 3 is a schematic representation illustrative of the changing operation in the fuel injection mode in relation to the time-dependent change of the frequency of misfires Er; the axis of abscissa indicates time t, and the axis of ordinate indicates the frequency of misfires Er, namely, the number of misfires detected in one minute.

The chart given in FIG. 3 shows the compression stroke injection mode M1 and M3, the suction stroke injection mode M2, a predetermined value Ea which provides the permissible level of the frequency of misfires Er, the period of time TA during which the frequency of misfires Er continues to exceed the predetermined value Ea, the period of time TB during which the injection mode is switched to the suction stroke injection mode M2, time t2 at which the compression stroke injection mode M1 is switched to the suction stroke injection mode M2, and time t3 (=t2+TB) at which the suction stroke injection mode M2 is switched to the compression stroke injection mode M3.

Figure 4:
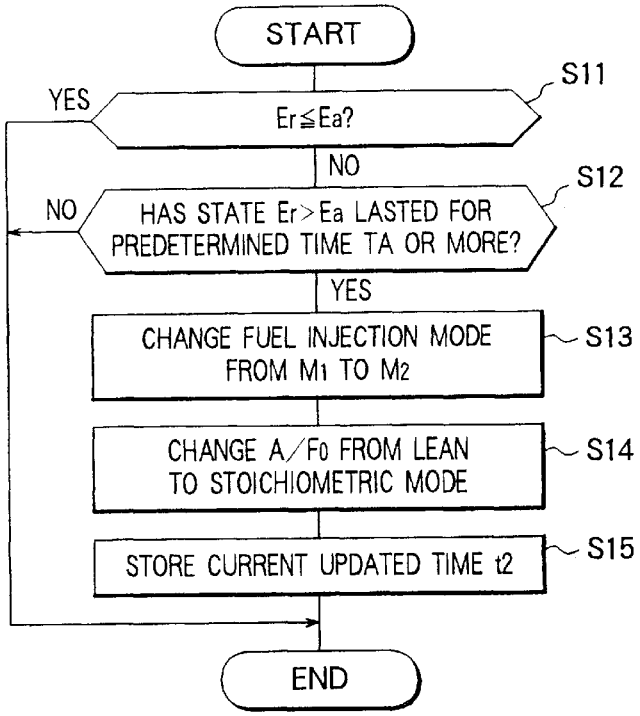
FIG. 4 is a flowchart illustrating the processing for changing in a compression stroke injection mode according to the first embodiment of the present invention.
Figure 5:
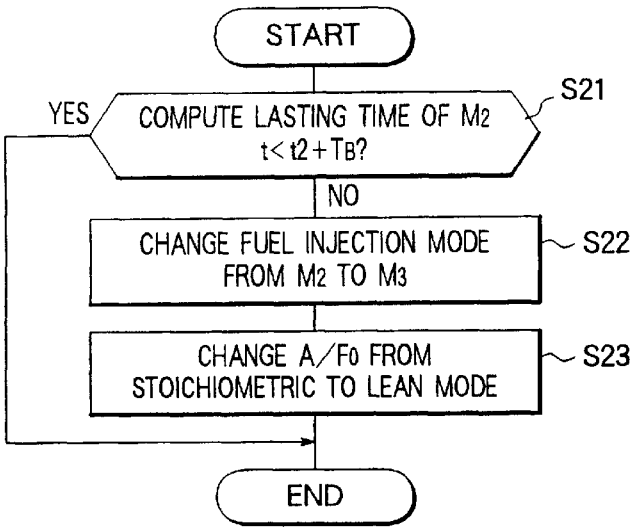
FIG. 5 is a flowchart illustrating the processing for resetting in a suction stroke injection mode according to the first embodiment of the present invention.

FIG. 4 is a flowchart illustrative of the details of the control processing in the compression stroke injection mode M1 in FIG. 3; and FIG. 5 is a flowchart illustrative of the details of the control in the suction stroke injection mode M2 for recovering the normal combustion state of the engine 1.

Referring now to the schematic representation of FIG. 3 and the flowcharts of FIG. 4 and FIG. 5, the processing implemented when the CPU has determined the occurrence of a misfire in step S3 of FIG. 2, that is, the processing implemented to reduce the misfires to restore the normal combustion state will be described.

In this case, if the frequency of misfires Er reaches the predetermined value Ea or more in the compression stroke injection mode M1, then the operational condition of the engine 1 is changed over to the suction stroke injection mode M2 so as to reduce the frequency of misfires Er.

In FIG. 4, the CPU 31 first determines whether the frequency of misfires Er is the predetermined value Ea or less (step S11), and if the determination result indicates Er≧Ea, i.e. if the determination result is YES, then the CPU 31 decides that the current frequency of misfires Er is the permissible level or less, and exits from the processing routine of FIG. 4.

If Er>Ea, i.e. if the determination result is NO, then the CPU judges whether the state wherein Er>Ea has continued for the predetermined time TA or more, i.e. whether t≧t1+TA (step S12).

If the duration of the state wherein Er>Ea is below the predetermined time TA and t<t1+TA, that is, if the determination result indicates NO, then the CPU exits from the processing routine of FIG. 4 to continue the compression stroke injection mode M1.

If the duration of the state wherein Er>Ea is the predetermined time TA or more, i.e. if the determination result is YES, then the CPU switches the fuel injection mode from the compression stroke injection mode M1 to the suction stroke injection mode M2 (step S13).

Subsequently, the CPU changes the target air/fuel ratio A/Fo from the lean operation mode to the stoichiometric (theoretical air/fuel ratio=14.7) operation mode (step S14), and stores time t2 at which the operation mode was changed (step S15), then exits from the processing routine of FIG. 4.

Thus, if the CPU detects, in step S1, the deterioration of the combustion state, i.e. an increase in the frequency of misfires Er, due to the occurrence of misfires, then it switches the operation of the engine 1 to the suction stroke injection mode M2 in step S13 after the predetermined time TA elapses.

Thus, the substances adhering to a spark plug 10 that is responsible for the drop in the insulation resistance of the spark plug 10 or the occurrence of misfires are burnt, so that the normal insulation resistance of the spark plug 10 is restored and the normal combustion state free of misfires is restored.

Hence, the ignition energy of the spark plug 10 increases, which in turn improves the combustion efficiency of the engine 1, making it possible to maintain a good combustion state of the engine 1.

By changing the operation mode of the engine 1 to the stoichiometric mode in step S14, the combustion efficiency of the engine 1 can be restored without the need for adding any new device; hence, an inexpensive system can be realized without adding to cost.

The details of the control conducted in the suction stroke injection mode M2 for restoring the normal combustion state of the engine 1 will now be described.

In FIG. 5, the CPU 31 first determines whether the duration of the suction stroke injection mode M2 from time t2 (stored in step S15) at which the operation mode was changed to current time t is below the predetermined time TB, namely, whether t<t2+TB (step S21).

The predetermined time TB is preset to be long enough for a substance adhering to the spark plug 10 to be burnt out in the suction stroke injection mode M2, so that the fuel control in the suction stroke injection mode M2 is continued until the substance on the spark plug 10 is burnt.

If the predetermined time TB has not yet elapsed from time t2 at which the fuel injection mode was switched from the compression stroke injection mode M1 to the suction stroke injection mode M2 and the duration of the suction stroke injection mode M2 is below the predetermined time TB, and the CPU determines that t<t2+TB, that is, if the determination result is YES, then the CPU exits from the processing routine of FIG. 5 so as to continue the suction stroke injection mode M2.

If the CPU decides in step S21 that t=t2+TB, that is, if the determination result is NO, then it means that the combustion in the suction stroke injection mode M2 has continued for the predetermined time TB, so that the CPU determines that the substance on the spark plug 10 has burnt out and the normal combustion efficiency has been recovered, and it switches the fuel injection from the suction stroke injection mode M2 to the compression stroke injection mode M3 (step S22).

Further, the CPU changes the target air/fuel ratio A/Fo from the stoichiometric (theoretical air/fuel ratio) operation mode to the lean operation mode in step S23, then exits from the processing routine of FIG. 5.

After restoring the combustion efficiency by changing the fuel injection to the suction stroke injection mode M2 as described above, the CPU sets the fuel injection back to the compression stroke injection mode M3.

When the suction stroke injection mode M2 is engaged to restore the normal combustion state from the misfire state, more fuel is consumed with resultant poor fuel consumption rate, but the fuel injection is set back to the compression stroke injection mode M3 as soon as the combustion efficiency is recovered, so that the operation mode wherein less fuel is consumed can be resumed.

At this time, since the normal combustion state has been recovered, the engine 1 can be operated in a better state than in the initial compression stroke injection mode M1; hence, the exhaust amount of harmful components of exhaust gas can be reduced in comparison with that before the normal combustion state was recovered.

Moreover, since the combustion torque of the engine 1 is stable, the drivability obtained in the compression stroke injection operation mode can be restored.

Second Embodiment

In the first embodiment described above, it has been determined that the combustion efficiency has been recovered if the operation in the suction stroke injection mode M2 continues for the predetermined time TB. The combustion efficiency, however, may not be sufficiently recovered due to variations in the engine 1, aging, etc.

For the aforesaid reason, in order to check the recovery of the combustion efficiency after setting the operation mode back to the compression stroke injection mode M3, it may be determined whether the frequency of misfires Er is a second predetermined value Eb (<Ea) or less after a relatively short predetermined time TC elapses from t3 at which the mode is reset.

By so doing, if the second predetermined value Eb is exceeded before the predetermined time TC elapses, then it is decided that the misfire state, i.e. the deterioration of the combustion efficiency, has taken place.

Figure 6:
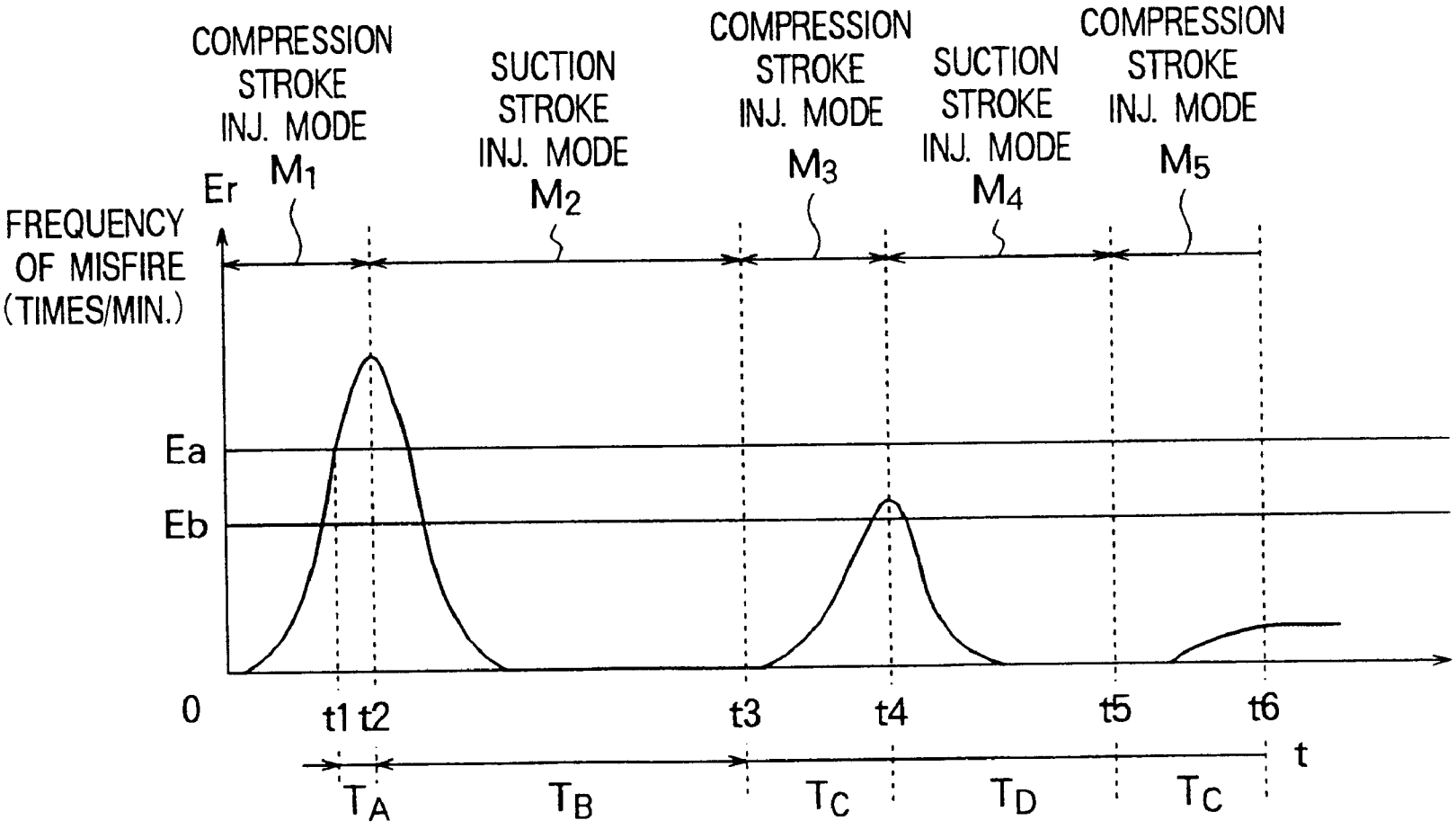
FIG. 6 is a schematic representation illustrative of the processing operation for changing the fuel injection mode according to the second embodiment of the present invention.

FIG. 6 is a schematic representation illustrative of the fuel injection mode changing operation according to the second embodiment of the present invention. The axis of abscissa indicates time t, and the axis of ordinate indicates the frequency of misfires Er; Ea, M1 through M3, t1 through t3, TA, and TB are the same as those in the first embodiment. The second embodiment refers to a case wherein the combustion efficiency cannot be recovered by the operation in the suction stroke injection mode M2 and the operation mode is switched to another suction stroke injection mode, M4.

Referring to FIG. 6, the operation is performed in the compression stroke injection mode M1 during the period of time from 0 to t2 (0 to t1+TA), in the suction stroke injection mode M2 during the period of time TB from t2 to t3, in the compression stroke injection mode M3 during the period of time TC (fixed time) from t3 to t4, in the suction stroke injection mode M4 during the period of time TD from t4 to t5, and in a compression stroke injection mode M5 during the period of time from t5 and after.

Time t3 is denoted by t2+TB, t4 by t3+TC, t5 by t4+TD, and t6 by t5+TC.

As previously described with reference to FIG. 3 through FIG. 5, during the period of time 0 to t3, when the predetermined time TA has passed since the frequency of misfires Er exceeded the predetermined value Ea, the operation mode is switched from the compression stroke injection mode M1 to the suction stroke injection mode M2 so that the target air/fuel ratio A/Fo is changed from the lean mode to the stoichiometric mode. Then, when the predetermined time TB has elapsed, the operation mode is switched from the suction stroke injection mode M2 back to the compression stroke injection mode M3 so that the stoichiometric mode is replaced by the lean mode.

Figure 7:
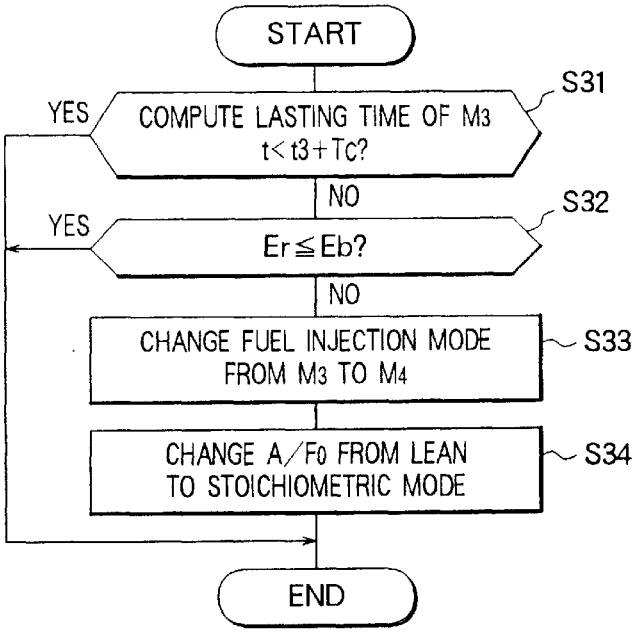
FIG. 7 is a flowchart illustrative of the changing processing in the compression stroke injection mode after recovery in accordance with the second embodiment of the present invention.

Referring now to the flowchart of FIG. 7, the processing for checking that the combustion efficiency has been restored after going back to the compression stroke injection mode M3.

Steps S33 and S34 in FIG. 7 correspond to steps S13 and S14 in FIG. 4.

First, to compute the lasting time of the compression stroke injection mode M3, the CPU judges whether the duration from time t3 at which the operation mode was set back to the compression stroke injection mode M3 to the current time t is below the predetermined time TC, i.e. whether t<t3+TC (step S31).

The predetermined time TC is the period of time for checking whether the combustion efficiency has been completely recovered; it can be set to a relatively short time according to the magnitude of the predetermined value Eb.

If the predetermined time TC has not yet elapsed from time t3 and the lasting time of the compression stroke injection mode M3 is below the predetermined time TC, and the CPU determines that t<t3+TC, i.e. the determination result is YES, then it exits from the processing routine of FIG. 7 without doing anything.

If the CPU decides in step S31 that t=t3+C, i.e. the determination result is NO, then it means that the combustion state in the compression stroke injection mode M3 has lasted for the predetermined time TC for checking; hence, the CPU determines whether the frequency of misfires Er is the predetermined value Eb or less in order to check that the frequency of misfires Er is being sufficiently controlled (step S32).

If Er≦Eb, i.e. the determination result is YES, then the CPU decides that the combustion efficiency has been recovered completely and exits from the processing routine of FIG. 7 so as to let the compression stroke injection mode M3 continue.

If Er>Eb, i.e. the determination result is NO, then the CPU decides that the combustion efficiency was not recovered in the previous suction stroke injection mode M2 and changes the fuel injection mode from the compression stroke injection mode M3 to the suction stroke injection mode M4 (step S33) and also changes the target air/fuel ratio A/Fo from the lean mode to the stoichiometric mode (step S34), then exits from the processing routine of FIG. 7.

At this time, as in step S15 described previously, time t4 at which the operation mode was changed is stored.

Referring now to the flowchart of FIG. 8, the processing operation performed in the second suction stroke injection mode M4 will be described.

Figure 8:
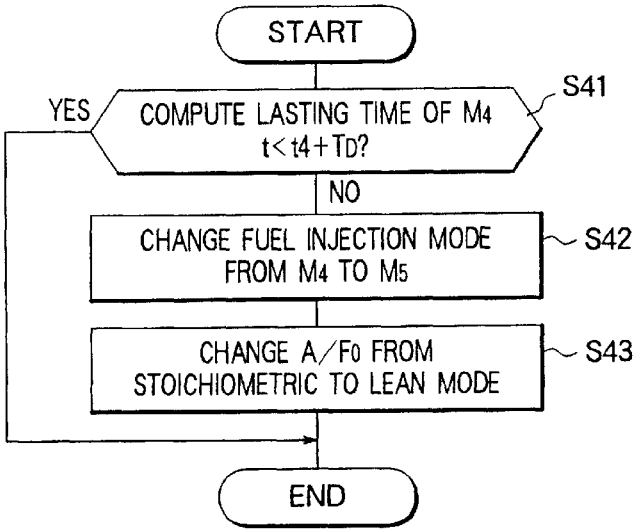
FIG. 8 is a flowchart illustrative of the recovery processing in the second suction stroke injection mode in accordance with the second embodiment of the present invention.

Steps S41 through S43 in FIG. 8 correspond to steps S21 through S23 in FIG. 5.

First, to compute the lasting time of the suction stroke injection mode M4, the CPU judges whether the duration of M4 from time t4 at which the operation mode was changed to the current time t is below the predetermined time TD, i.e. whether t<t4+TD (step S41).

The predetermined time TD is the period of time is for the second mode changing processing, so that it can be set to a time shorter than the previous predetermined time TB.

If the predetermined time TD has not yet elapsed from time t4 and the CPU determines in step S41 that t<t3+TC, i.e. the determination result is YES, then it exits from the processing routine of FIG. 8 without doing anything so as to continue the suction stroke injection mode M4.

If the CPU decides that t=t4+TD, i.e. the determination result is NO, then it means that the combustion state in the suction stroke injection mode M4 has lasted for the predetermined time TD; hence, the CPU determines that the combustion efficiency has been recovered by the second mode changeover processing, and it changes the fuel injection mode from the suction stroke injection mode M4 back to the compression stroke injection mode M5 in step S42.

The CPU also changes the target air/fuel ratio A/Fo from the stoichiometric mode to the lean mode (step S43), then exits from the processing routine of FIG. 8.

Thus, if it is determined that the combustion efficiency has not been recovered after the fuel injection mode is set back to the compression stroke injection mode M3, the fuel injection mode is changed to the suction stroke injection mode M4 again so as to securely recover the combustion efficiency.

As in the case of the processing operation shown in FIG. 7, the control processing in the compression stroke injection mode M5 is repeated.

More specifically, in step S31 of FIG. 7, the CPU replaces time t3 by t5, then carries out the same determination processing to check the frequency of misfires Er after the predetermined time TC elapses from time t5 (step S32).

In this case, since the combustion efficiency has been securely recovered by the second suction stroke injection mode M4, it is determined that Er≦Eb (the determination result is YES), and the operation in the compression stroke injection mode M5 is further continued.

If it is determine that the combustion efficiency has not yet been completely recovered, then the third or more suction stroke injection mode is repeated as in the cases shown in FIG. 7 and FIG. 8.

Thus, the combustion state, namely, the frequency of misfires Er, observed when the fuel injection mode has been switched from the suction stroke injection mode M2 to the compression stroke injection mode M3 is detected, and if the combustion efficiency is not good, then the fuel injection is set to the suction stroke injection mode M4 again. This makes it possible to securely recover the combustion efficiency, thus preventing the operation in the compression stroke injection mode M3 from being continued with the normal combustion state incompletely recovered.

If the combustion efficiency is found to be good after the elapse of the predetermined time TC following the change back to the compression stroke injection mode M3, then the operation in the compression stroke injection mode M3 is continued. Hence, the time in which the operation is performed in the suction stroke injection mode M2 can be minimized by setting the duration, namely, the predetermined time TB, of the first suction stroke injection mode M2 to a minimum.

In other words, to completely recover the normal combustion state, it is unnecessary to set the predetermined time TB in the first suction stroke injection mode M2 to a large value; instead, the second and subsequent suction stroke injection mode should be repeated as necessary for the predetermined time TD.

Hence, the time in which the operation is performed in the suction stroke injection mode consuming more fuel can be minimized; therefore, less fuel is consumed with resultant greatly improved economy.

Third Embodiment

In the first and second embodiments described above, when the frequency of misfires increases, the operation of the engine 1 is switched from the compression stroke injection mode M1 to the suction stroke injection mode M2. As an alternative, however, the target air/fuel ratio A/Fo may be changed to enrich a mixture in steps by a predetermined amount at a time while keeping the fuel injection mode in the compression stroke injection mode M1.

Figures 9A, 9B:
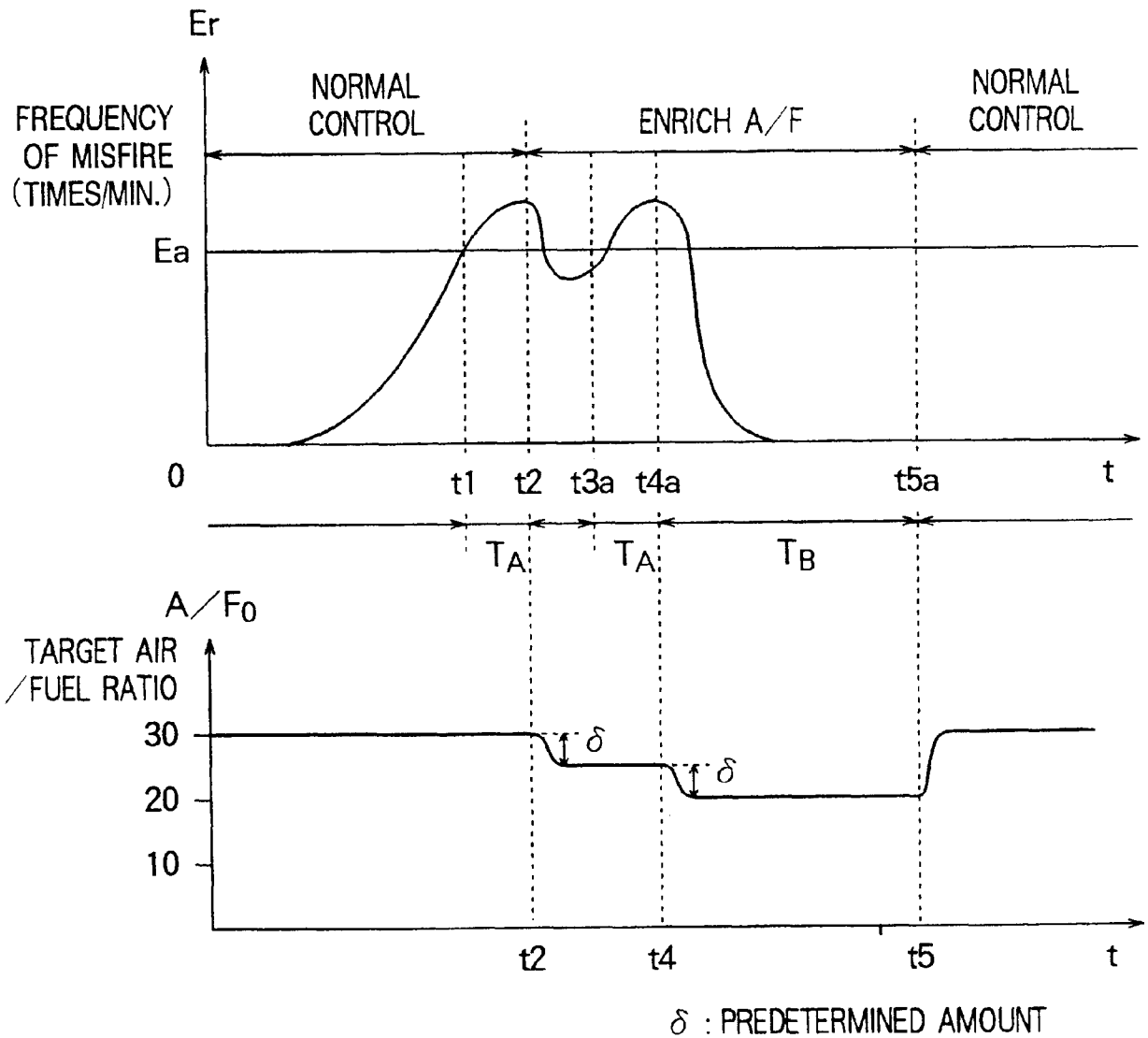
FIG. 9A and FIG. 9B are schematic representations illustrative of the processing operation for changing an air/fuel ratio in accordance with a third embodiment of the present invention.

FIG. 9A and FIG. 9B are schematic representations illustrative of the operation for changing the target air/fuel ratio A/Fo relative to the frequency of misfires Er according to the third embodiment of the present invention. FIG. 9A shows time t on the axis of abscissa and the frequency of misfires Er on the axis of ordinate. FIG. 9B shows time t on the axis of abscissa and the target air/fuel ratio A/Fo on the axis of ordinate.

In FIGS. 9A and 9B, Ea, t1, t2, TA, and TB are the same as those previously described. The predetermined time TB is set to a value which is adequate for the normal combustion efficiency to be recovered.

Reference character δ denotes a predetermined value for changing the target air/fuel ratio A/Fo, the value being a relatively small value; it is set so that it reduces the target air/fuel ratio A/Fo in steps if the misfire state has been detected.

Reference character t3*a* denotes the time when the frequency of misfires Er exceeded the predetermined value Ea again after the first enriching processing, reference character t4*a* denotes the time when the second enriching processing was executed, and t5*a* denotes the time when the normal control was resumed.

This embodiment refers to a case where the state in which Er≦Ea lasts for the predetermined time TB by carrying out the second enriching processing at time t4*a*, so that the CPU determines that the normal combustion efficiency has been recovered and resumes the normal control at time t5*a*.

Referring now to FIGS. 9A and 9B, and the flowcharts shown in FIG. 10 and FIG. 11, the control processing operation in accordance with the third embodiment of the present invention will be described.

Figure 10:
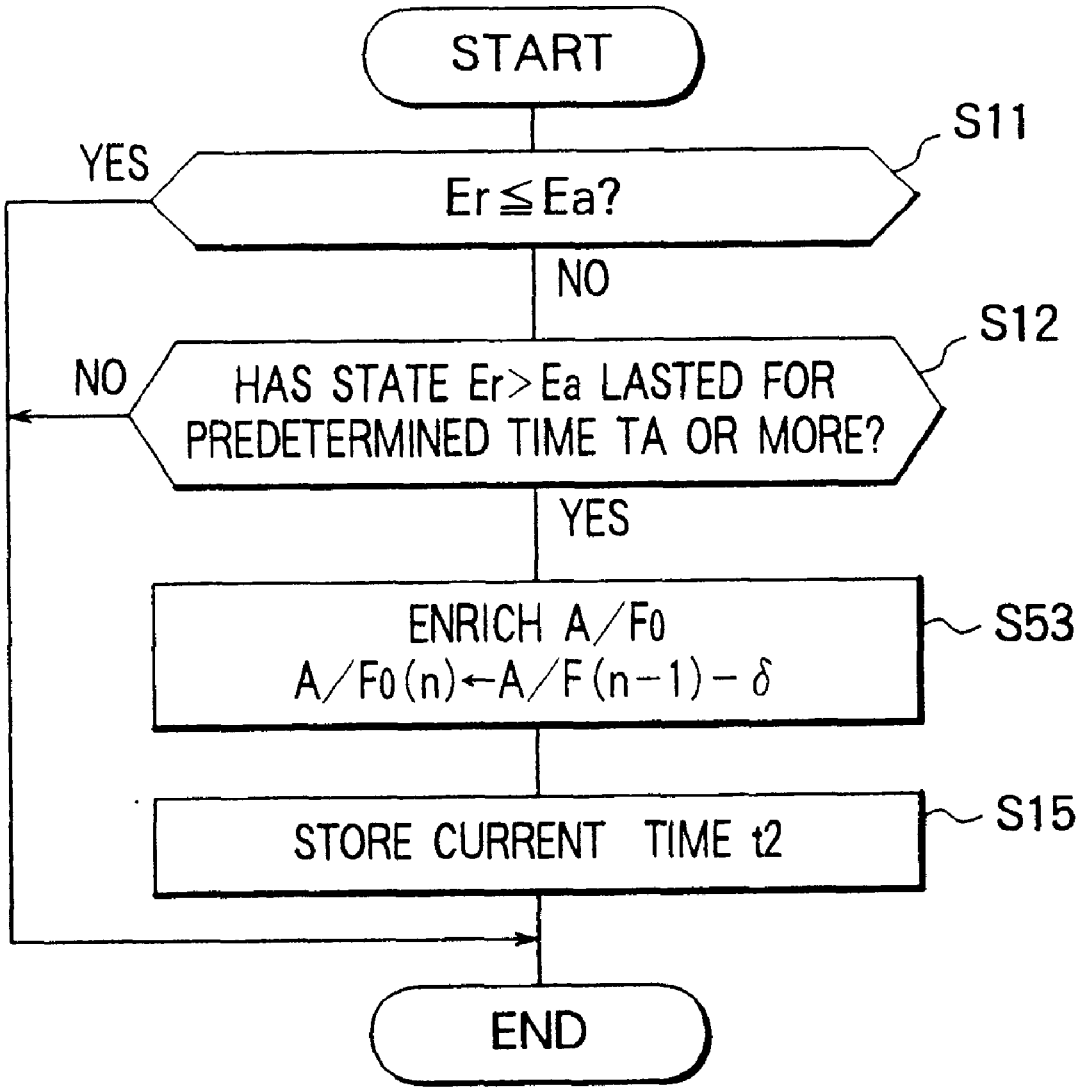
FIG. 10 is a flowchart illustrative of the processing for changing the air/fuel ratio in accordance with a third embodiment of the present invention.
Figure 11:
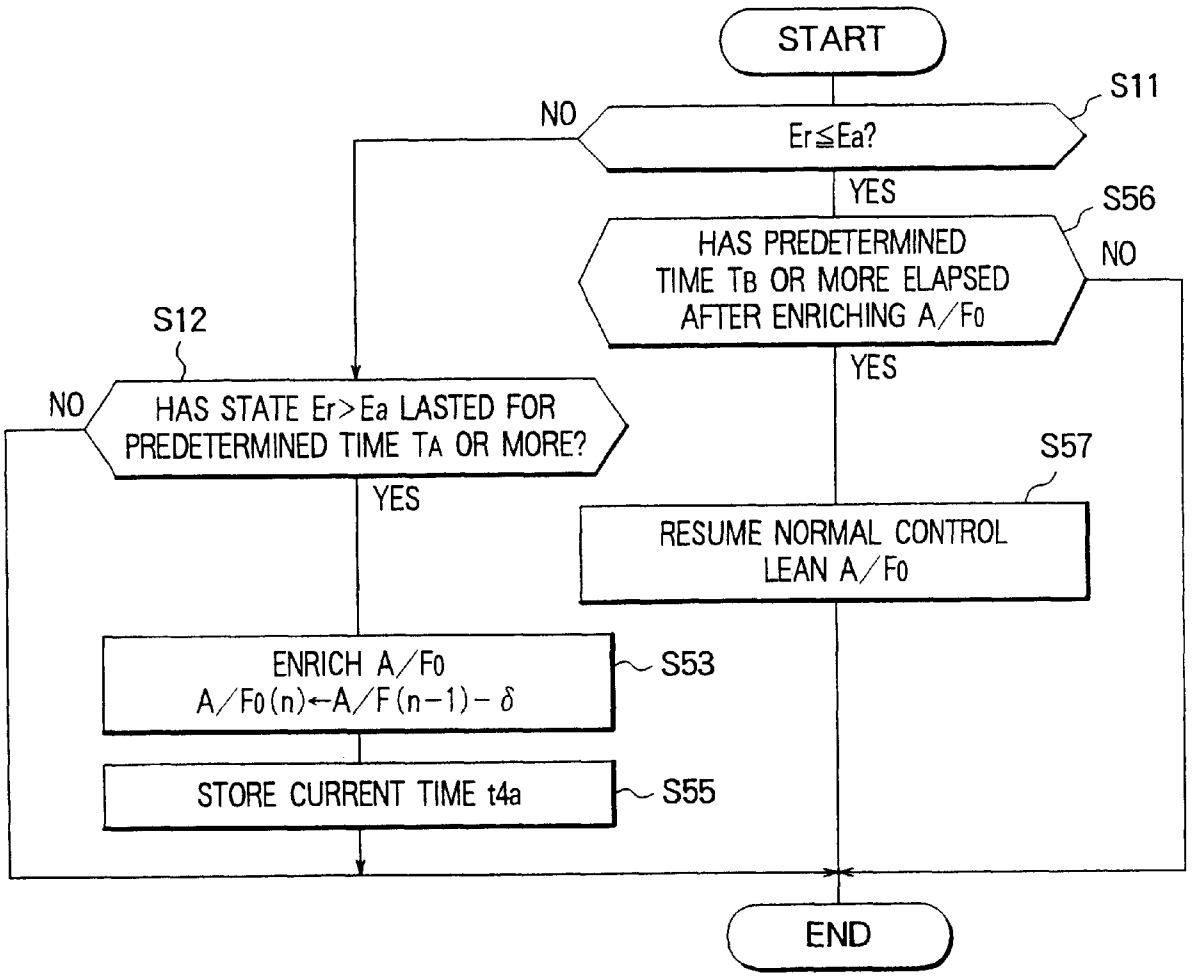
FIG. 11 is a flowchart illustrative of the processing for restoring the air/fuel ratio in accordance with a third embodiment of the present invention.

In FIG. 10 and FIG. 11, steps S11, S12, and S15 are the same as those shown in FIG. 4.

If the CPU determines in step S11 of FIG. 10 that Er>Ea, i.e., if the determination result is NO, and also determines in step S12 that the state wherein Er>Ea has lasted for the predetermined time TA or more, i.e. the determination result is YES, then it switches the subsequent target air/fuel ratio A/Fo(n) to the rich mode by decreasing the current target air/fuel ratio A/Fo(n−1) by the predetermined value δ (step S53).

The CPU stores the then time t2 in step S15 before it exits from the processing routine of FIG. 10.

When the target air/fuel ratio A/Fo has been enriched by the predetermined value δ, the processing routine of FIG. 11 is implemented after time t2.

The CPU first judges whether the frequency of misfires Er is the predetermined value Ea or less in step S11 and if Er>Ea, i.e. if the determination result is NO, then it judges in step S12 whether the state in which Er>Ea has lasted for the predetermined time TA or more from time t3*a* as in the case described in conjunction with FIG. 10.

When the predetermined time TA elapses from time t3*a*, the CPU further enriches the target air/fuel ratio A/Fo by the predetermined amount δ in step S53, and stores the then time t4*a* in step S55 before exiting from the processing routine of FIG. 11.

At the time of implementing the next processing, if the CPU decides in step S11 that Er≦Ea, i.e. if the determination result is YES, then the CPU determines in step S56 whether the predetermined time TB or more has passed from time t4*a* at which the target air/fuel ratio A/Fo was enriched the second time.

If the time elapsed from time t4*a* at which the target air/fuel ratio A/Fo was enriched is below the predetermined time TB, i.e. if the determination result is NO, then the CPU terminates the processing routine of FIG. 11 without doing anything so as to maintain the rich mode.

If the CPU decides in step S56 that the predetermined time TB or more has passed from time t4*a*, i.e. if the determination result is YES, then it readjusts the target air/fuel ratio A/Fo to lean the mixture, then goes back to the normal control in step S57 before exiting from the processing routine of FIG. 11.

Thus, if the frequency of misfires Er increases, the target air/fuel ratio A/Fo is enriched by the predetermined amount δ at a time to burn stain or the like on the spark plug 10, so that the combustion efficiency can be recovered and the frequency of misfires Er can be reduced.

In the third embodiment, the normal combustion state can be restored while continuing the compression stroke injection mode in which the target air/fuel ratio A/Fo is in the lean mode. Hence, the third embodiment consumes less fuel than the first and second embodiments, enabling economical operation to be maintained.

Further, if the frequency of misfires Er does not decrease sufficiently even after enriching the target air/fuel ratio A/Fo, the target air/fuel ratio A/Fo is further enriched, thus enabling the frequency of misfires Er to be securely reduced by implementing a minimum of enriching processing.

Moreover, since the normal combustion state of the engine 1 can be restored with the target air/fuel ratio in the leanest mode, further saving of fuel is possible, permitting economical operation.

In this embodiment, since the target air/fuel ratio A/Fo for restoring the normal combustion state is not fixed, high flexibility is permitted to successfully cope with diverse variations in the operating conditions in the same engine 1 or variations in weather, or variations from one engine 1 to another.

As in the case of the second embodiment, the combustion state determining means in the CPU 31 uses the second predetermined value Eb which is smaller than the first predetermined value Ea to check the frequency of misfires after the predetermined time TC passes from the time when the air/fuel ratio was set back to the lean mode so as to check the recovery of the combustion efficiency after going back to the normal control.

Fourth Embodiment

In the third embodiment described above, when the frequency of misfires Er increases, the target air/fuel ratio A/Fo is changed to the rich mode. Alternatively, however, the ignition signal G for the ignition coil unit 9 shown in FIG. 27 may be changed.

Referring now to FIGS. 12A through 12D and FIG. 13, the changing processing in accordance with the fourth embodiment of the present invention will be described.

Figures 12A, 12B:
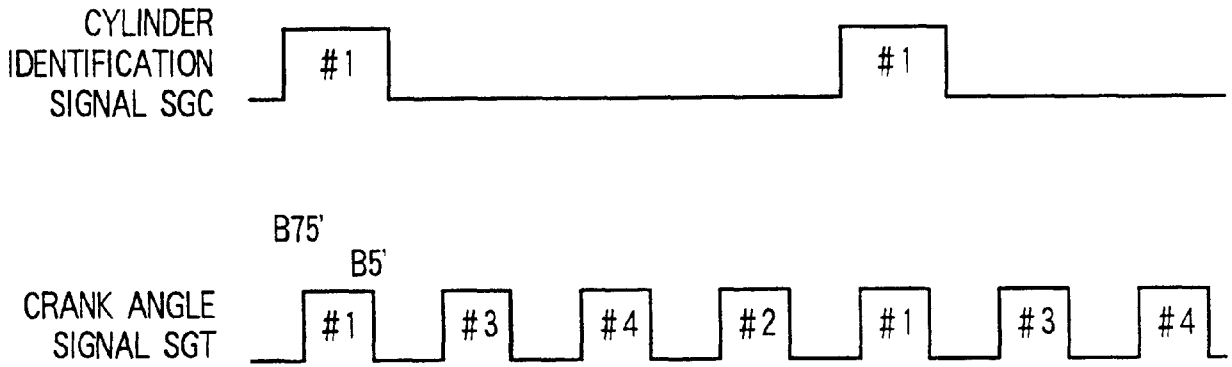
FIG. 12A through FIG. 12D are timing charts illustrative of the processing operation for changing the ignition control in accordance with a fourth embodiment of the present invention.
Figure 12C:
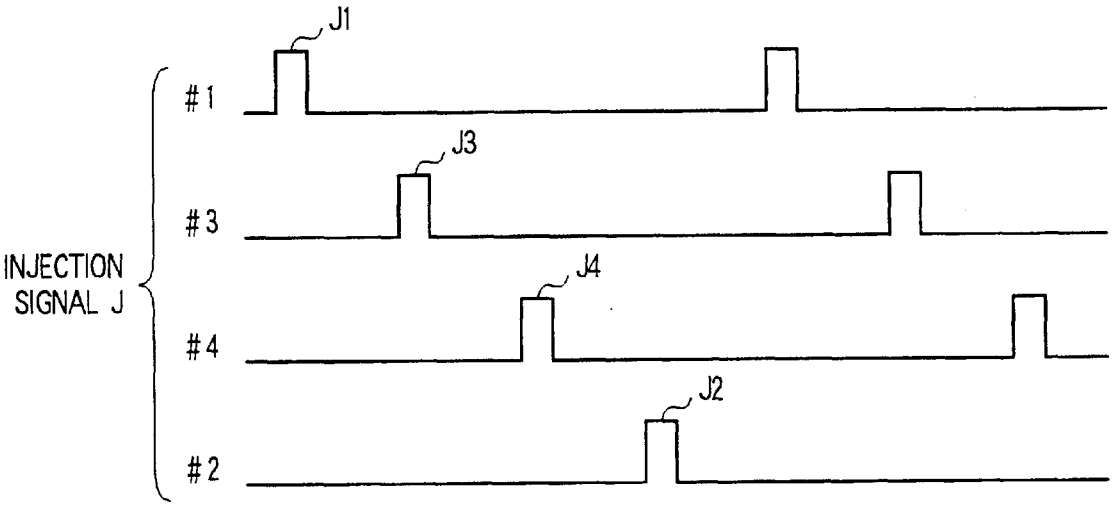
Figure 12D:
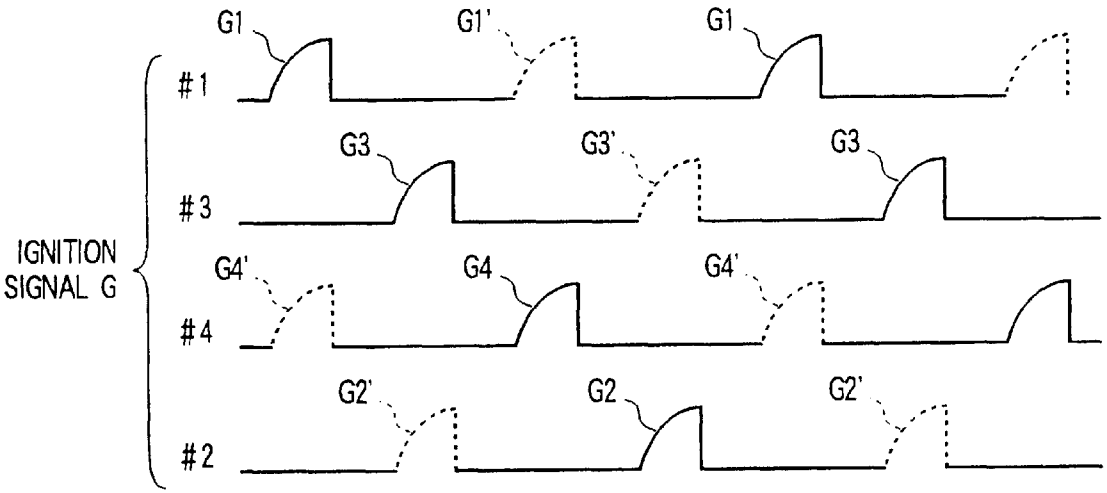

FIG. 12A through FIG. 12D are timing charts illustrative of the changing processing operation in accordance with the fourth embodiment of the present invention; FIG. 12A is the timing chart of a cylinder identification signal SGC, FIG. 12B is a timing chart of a crank angle signal SGT, FIG. 12C is an injection signal for a fuel injection valve 8 for each of cylinders #1 through #4, and FIG. 12D is a timing chart of the ignition signal for an ignition coil unit 9 for each cylinder.

In FIGS. 12A through 12D, J1 through J4 denote the injection signals for cylinders #1 through #4, and G1 through G4 denote the ignition signals for the cylinders.

In a normal operation condition, if the CPU detects the crank angle signal SGT of cylinder #1, for example, it drives the fuel injection valve 8 corresponding to cylinder #1 by issuing the injection signal J1 and drives only a spark coil unit 9 keyed to cylinder #1 by issuing the ignition signal G1, thereby controlling the combustion in cylinder #1.

Figure 13:
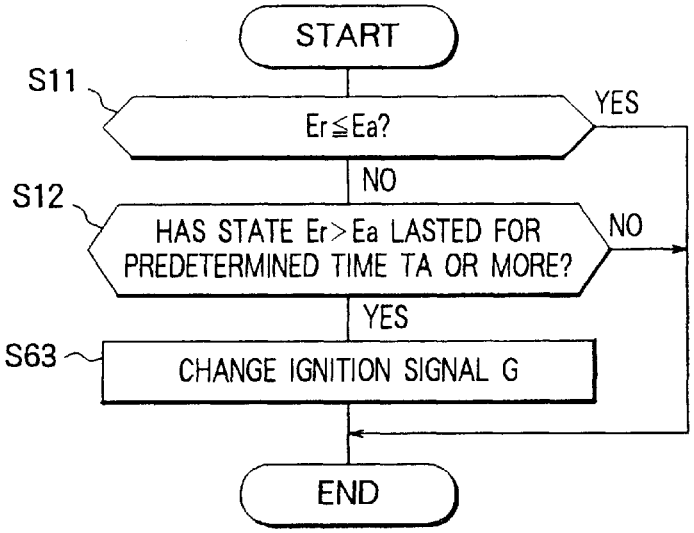
FIG. 13 is a flowchart showing the ignition control changing processing in accordance with a fourth embodiment of the present invention.

FIG. 13 is a flowchart illustrative of the changing processing operation according to the fourth embodiment of the present invention; steps S11 and S12 are the same as those described above.

First, in step S11, the CPU judges whether the frequency of misfires Er (see FIG. 9) is the predetermined value Ea or less, and if it decides that Er≦Ea, that is, if the determination result is YES, then it exits from the processing routine of FIG. 13.

If the CPU decides that Er>Ea, that is, if the determination result is NO, then it further judges in step S12 whether the state wherein Er>Ea has lasted for the predetermined time TA or more; if it decides that the state has lasted for the predetermined time TA, then it changes the ignition signal G to change the driving method for the ignition coil unit 9 in step S63 before it exits from the processing routine of FIG. 13.

To be more specific, as shown in FIG. 12D, the CPU issues an ignition signal G4' which is shown in dashed lines and which is used for driving the ignition coil unit 9 for other cylinder, e.g. cylinder #4, in addition to the cylinder, e.g. cylinder #1, which corresponds to the crank angle signal SGT.

At this time, the cylinder driven and ignited at the same time when cylinder #1 in the compression stroke is driven and ignited will be cylinder #4 in an exhaust stroke which will not be affected at all by the ignition signal G4' applied at the same time as the ignition signal G1.

In a similar manner, an ignition signal G2' indicated by dashed lines for cylinder #2 is applied at the same time when an ignition signal G3 is applied to cylinder #3.

Thus, if the frequency of misfires Er increases, the ignition signal G is applied to the ignition coil unit 9 at a timing in addition to the regular ignition timing so as to increase the chances of burning the substances on the spark plug 10 attributable to a drop in the insulation resistance thereof. Hence, the adhering substances are reduced, so that the spark plug 10 restores its normal insulation resistance, permitting improved combustion efficiency.

In this case, there is no need to change the fuel injection state or the target air/fuel ratio A/Fo, and the combustion efficiency of the engine 1 can be recovered while continuing the operation in the lean mode, that is, the compression stroke injection mode which is an advantage of the cylinder injection engine. This feature enables economical operation to be maintained since the fuel consumption rate is not deteriorated.

The engine 1 is controlled in the same way as that before the normal combustion state is restored except that the additional ignition signals G1' through G4' are applied to the ignition coil units 9 at the timings irrelevant to the ignition of fuel, i.e. during the. exhaust stroke. Accordingly, no particular difference is observed in the behavior of the engine 1 between the state wherein the ignition signals G1' through G4' are applied to restore the normal combustion and the state wherein none of the ignition signals G1' through G4' are applied since no restoring operation is being performed. Hence, no shock due to a change in the behavior of the engine 1 occur, so that there is no need to provide measures for controlling such shock.

As in the case of the second embodiment, the combustion state determining means in the CPU 31 may compare the frequency of misfires with the second predetermined value Eb which is smaller than the first predetermined value Ea after the predetermined time TC has elapsed from the time at which the normal control was resumed so as to check the recovery of the combustion efficiency after resuming the normal control.

Fifth Embodiment

In the fourth embodiment described above, the ignition signal G is changed when the frequency of misfires Er has increased. Alternatively, however, the fuel injection timing based on the injection signal J and the ignition timing based on the ignition signal G may be changed.

Figure 14:
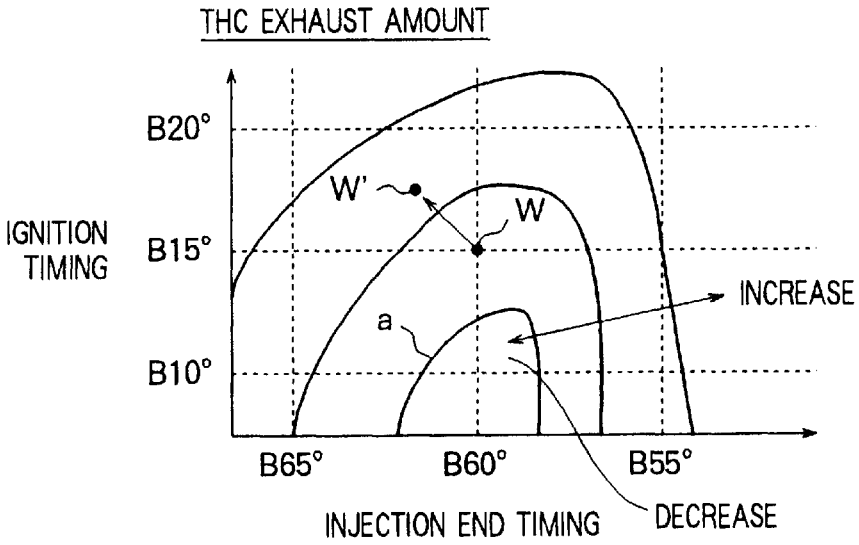
FIG. 14 is a schematic representation illustrative of the processing operation for changing the fuel injection timing and the ignition timing in relation to the exhaust amount of THC in accordance with a fifth embodiment of the present invention.
Figure 15:
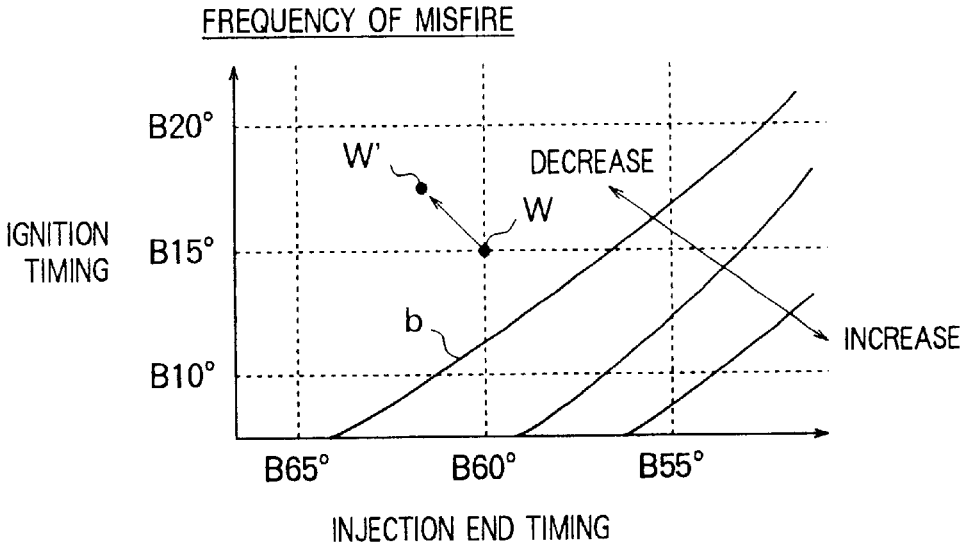
FIG. 15 is a schematic representation illustrative of the processing operation for changing the fuel injection timing and the ignition timing in relation to the frequency of misfires in accordance with the fifth embodiment of the present invention.
Figure 16:
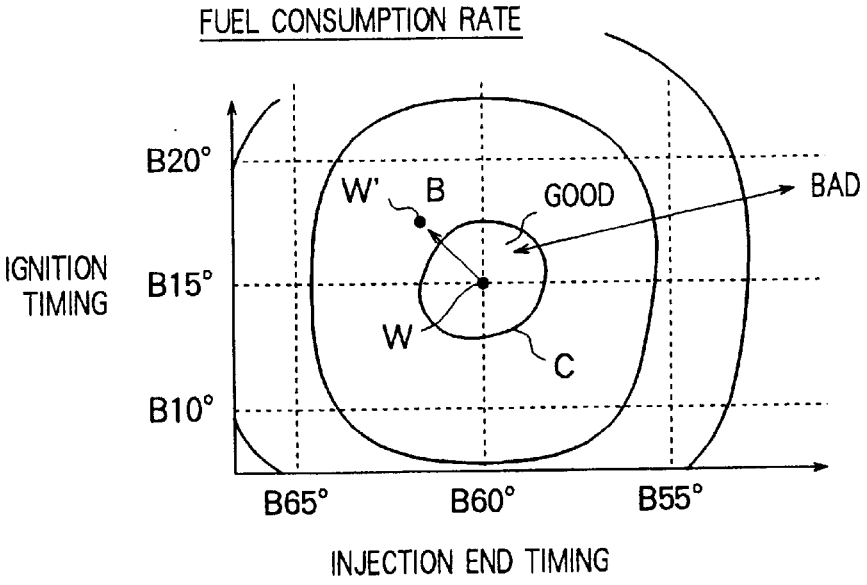
FIG. 16 is a schematic representation illustrative of the processing operation for changing the fuel injection timing and the ignition timing in relation to the fuel consumption efficiency in accordance with the fifth embodiment of the present invention.

Referring now to FIG. 14 through FIG. 16, the changing procedure according to a fifth embodiment of the present invention will be described.

Figure 34:
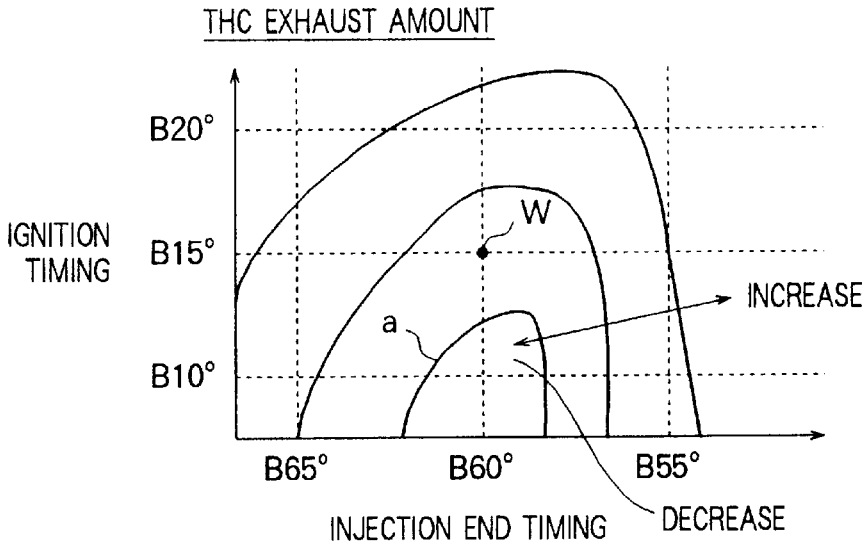
FIG. 34 is a schematic representation showing conventional fuel injection timing and ignition timing in relation to the exhaust amount of THC.
Figure 35:
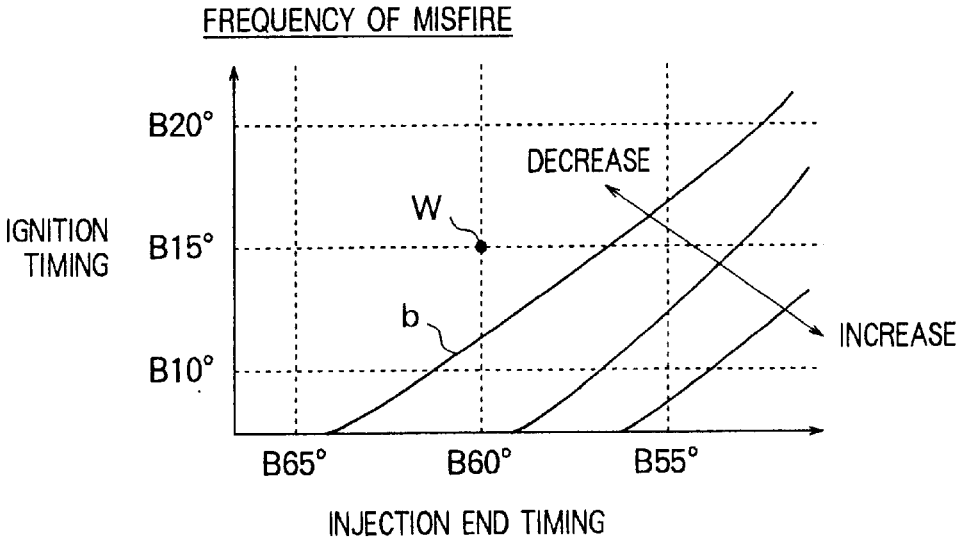
FIG. 35 is a schematic representation showing conventional fuel injection timing and ignition timing in relation to the frequency of misfires.
Figure 36:
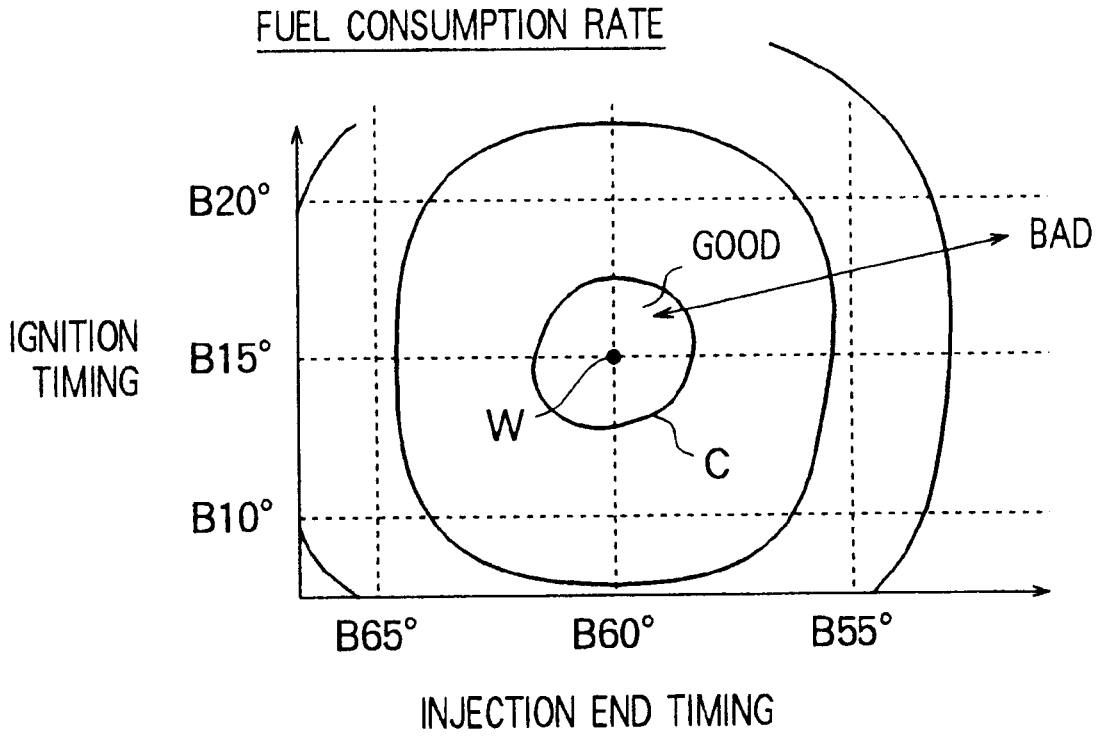
FIG. 36 is a schematic representation showing conventional fuel injection timing and ignition timing in relation to the fuel consumption efficiency.

FIG. 14 through FIG. 16 are the same schematic representations as FIG. 34 through FIG. 36 previously mentioned; they illustrate the combustion efficiency of the engine 1 at the fuel injection timing and the ignition timing under a certain operating condition.

In the figures, point W (injection end timing=B60 degrees; ignition timing=B15 degrees) indicates the injection end timing and the ignition timing when the engine 1 is being driven in the normal state as described previously.

In this embodiment, if the state wherein the frequency of misfires Er shown in FIG. 9A exceeds the predetermined value Ea has lasted for the predetermined time TA or longer, then the fuel injection timing and the ignition timing are shifted from point W to reduce the frequency of misfires Er.

For instance, the fuel injection timing and the ignition timing are moved to point W' (fuel injection timing=B62 degrees; ignition timing=B17 degrees).

Thus, applying the processing means for changing the fuel injection timing and the ignition timing as the recovering means when the frequency of misfires Er has increased makes it possible to instantly improve the combustion efficiency from the combustion stroke at which the injection timing and the ignition timing have been changed, permitting the time in which the engine is run in a poor combustion state to be minimized.

Moreover, as in the case of the fourth embodiment, since the target air/fuel ratio A/Fo need not be changed, the combustion efficiency can be restored while maintaining the economical operation mode in which less fuel is consumed.

Furthermore, according to the fifth embodiment of the present invention, only the operational state need to be changed, and no additional system is required, leading to no increase in cost.

As in the case of the second embodiment described above, the combustion state determining means in the CPU 31 may compare the frequency of misfires with the second predetermined value Eb which is smaller than the first predetermined value Ea after the predetermined time TC has elapsed from the time at which the normal operational state was resumed so as to check the recovery of the combustion efficiency after resuming the normal control.

Sixth Embodiment

In the first embodiment described above, the occurrence of a misfire has been detected according to the rotational change D (see FIG. 1 and FIG. 2). As an alternative, however, the misfires may be detected using an ionic current C from an ionic current detecting unit 19 shown in FIG. 27.

Referring now to FIGS. 17A through 17D and FIG. 18, the misfire detecting operation in accordance with a sixth embodiment of the present invention will be described.

Figure 17:
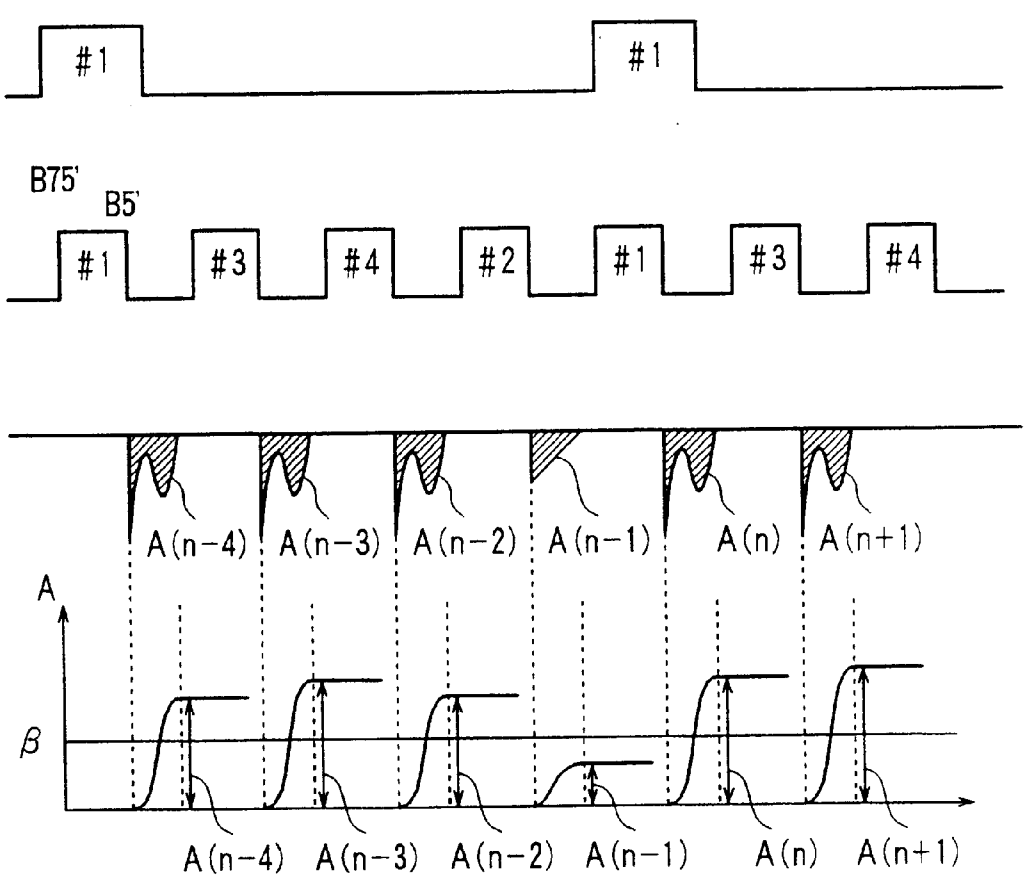
FIG. 17A through FIG. 17D are timing charts illustrative of a misfire determination processing operation based on an ionic current in accordance with a sixth embodiment of the present invention.

FIG. 17A through FIG. 17D are timing charts illustrating the processing operation for detecting a misfire in the engine 1 according to the ionic current C. FIG. 17A and FIG. 17B show the same cylinder identification signal SGC and the crank angle signal SGT described above with reference to FIG. 1. FIG. 17C shows the waveform of the ionic current C, and FIG. 17D shows portions denoted by A of the waveform area of the ionic current C, i.e. the integrated value of the hatched portions in FIG. 17C.

As it is widely known, the ionic current C corresponds to the amount of the ionic components generated during the combustion of fuel; it indicates the degree of combustion.

A(i)(i=n−4, n−3, . . . , n, . . . ) is the waveform area A of the ionic current C for each computation timing (i).

Figure 18:
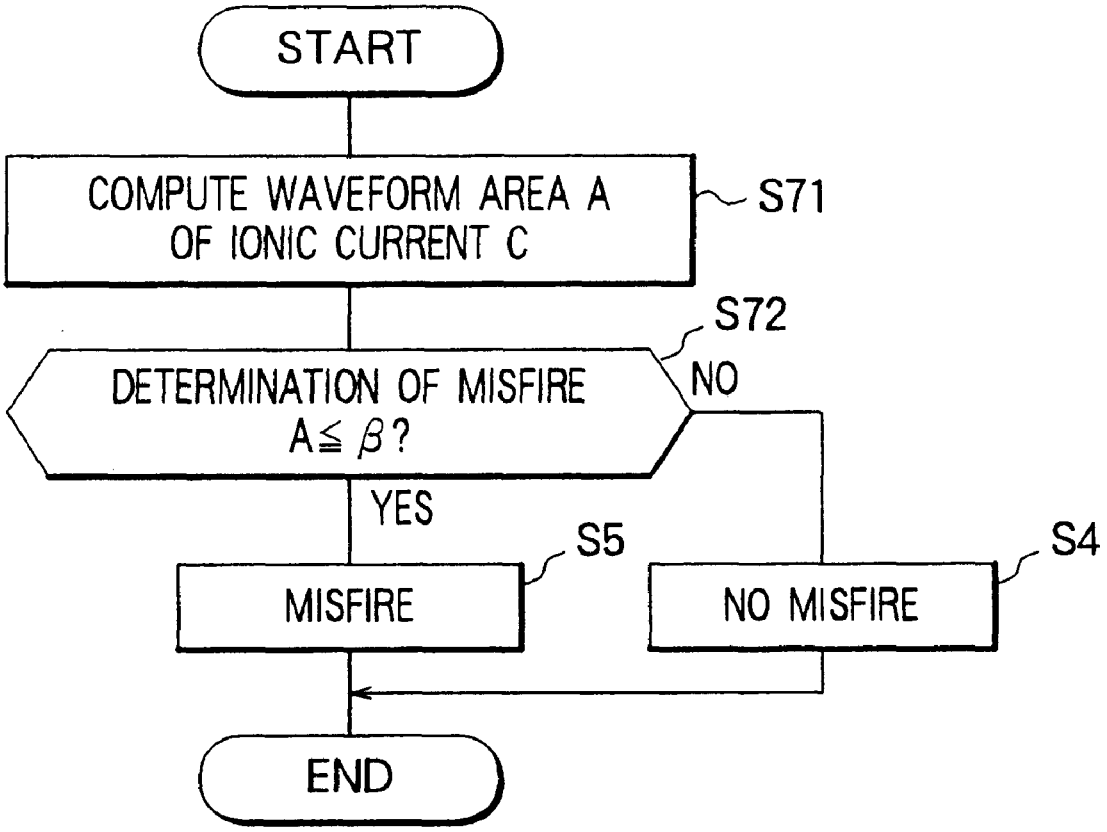
FIG. 18 is a flowchart illustrative of a misfire determination processing operation based on an ionic current in accordance with the sixth embodiment of the present invention.

FIG. 18 is a flowchart illustrating the misfire determination processing based on the waveform area A of the ionic current C; steps S4 and S5 are the same steps shown in FIG. 2.

First, the CPU 31 in the electronic control unit 20 shown in FIG. 28 computes the waveform area A of the ionic current C in response to the occurrence of the interrupt of the falling edge of the crank angle signal SGT (step S71).

Subsequently, the CPU judges in step S72 whether a misfire has occurred according as whether the waveform area A of the ionic current C is a predetermined value β or less, and if it finds that A>β, i.e. the determination result is NO, then it proceeds to step S4 and decides that no misfire has occurred; the CPU then exits from the processing routine of FIG. 18.

If the CPU decides that A≦β, i.e. the determination result is YES, it proceeds to step S5 and decides that a misfire has occurred, and exits from the processing routine of FIG. 18.

Seventh Embodiment

In the sixth embodiment described above, the occurrence of a misfire has been detected according to the ionic current C. As an alternative, however, a misfire may be detected based on a difference ΔA/F between an actual air/fuel ratio A/Fr and the target air/fuel ratio A/Fo by computing the actual air/fuel ratio A/Fr using an oxygen concentration X in exhaust gas which is detected by an oxygen concentration sensor 15 shown in FIG. 27.

In this embodiment, the CPU 31 is equipped with a means for computing the actual air/fuel ratio A/Fr from the oxygen concentration X, and a means for computing the air/fuel ratio difference ΔA/F between the target air/fuel ratio A/Fo and the actual air/fuel ratio A/Fr.

Referring to FIGS. 19A through 19C and FIG. 20, the misfire detecting operation in accordance with a seventh embodiment will now be described.

Figures 19A, 19B, 19C:
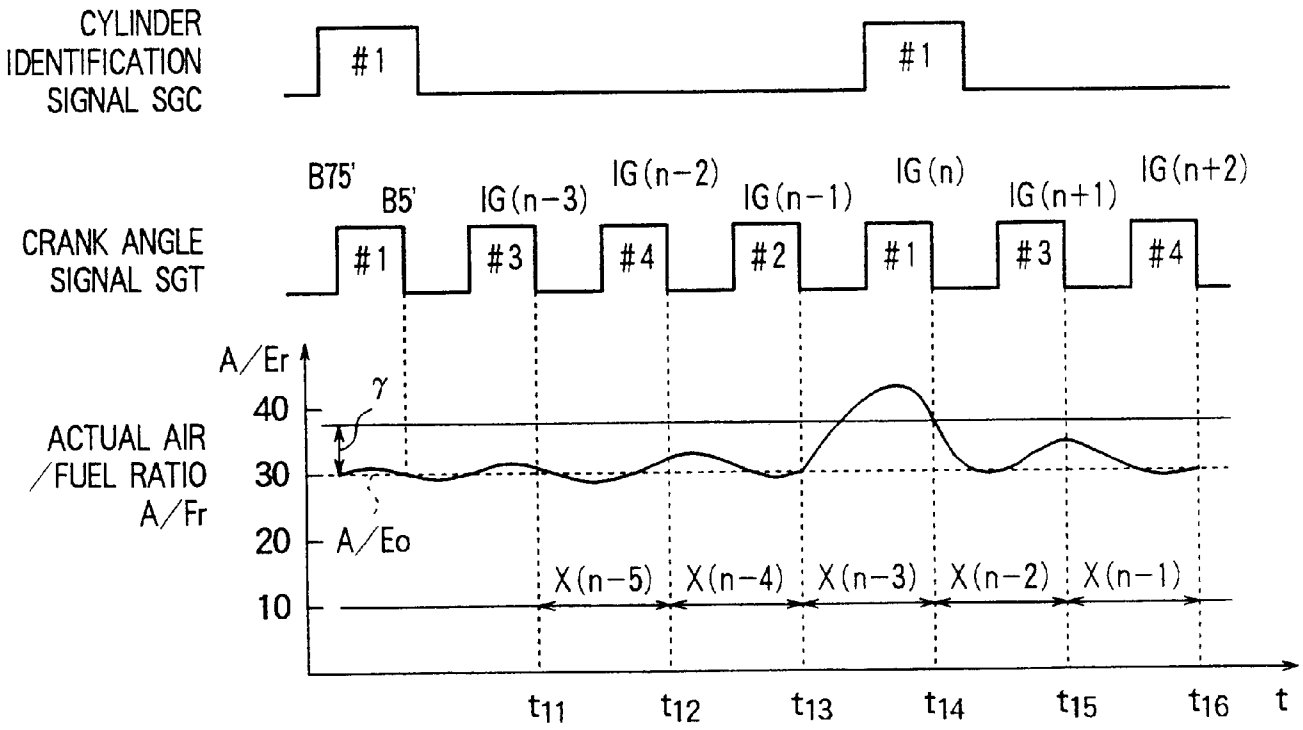
FIG. 19A through FIG. 19C are timing charts illustrative of the processing operation for determining misfires by using an air/fuel ratio based on the concentration of oxygen in accordance with a seventh embodiment of the present invention.

FIG. 19A through FIG. 19C are timing charts illustrative of the processing operation for detecting a misfire in the engine 1 from the ionic current C; FIG. 19A and FIG. 19B show the same cylinder identification signal SGC and the crank angle signal SGT as described previously, and FIG. 19C shows the time-dependent change in the actual air/fuel ratio A/Fr computed from the oxygen concentration X.

In FIGS. 19A through 19C, IG(i) (i=n−3, n−2, . . . , n, . . . , n+2) corresponding to time t11 through t16 indicates the ignition timing for each cylinder.

Figure 20:
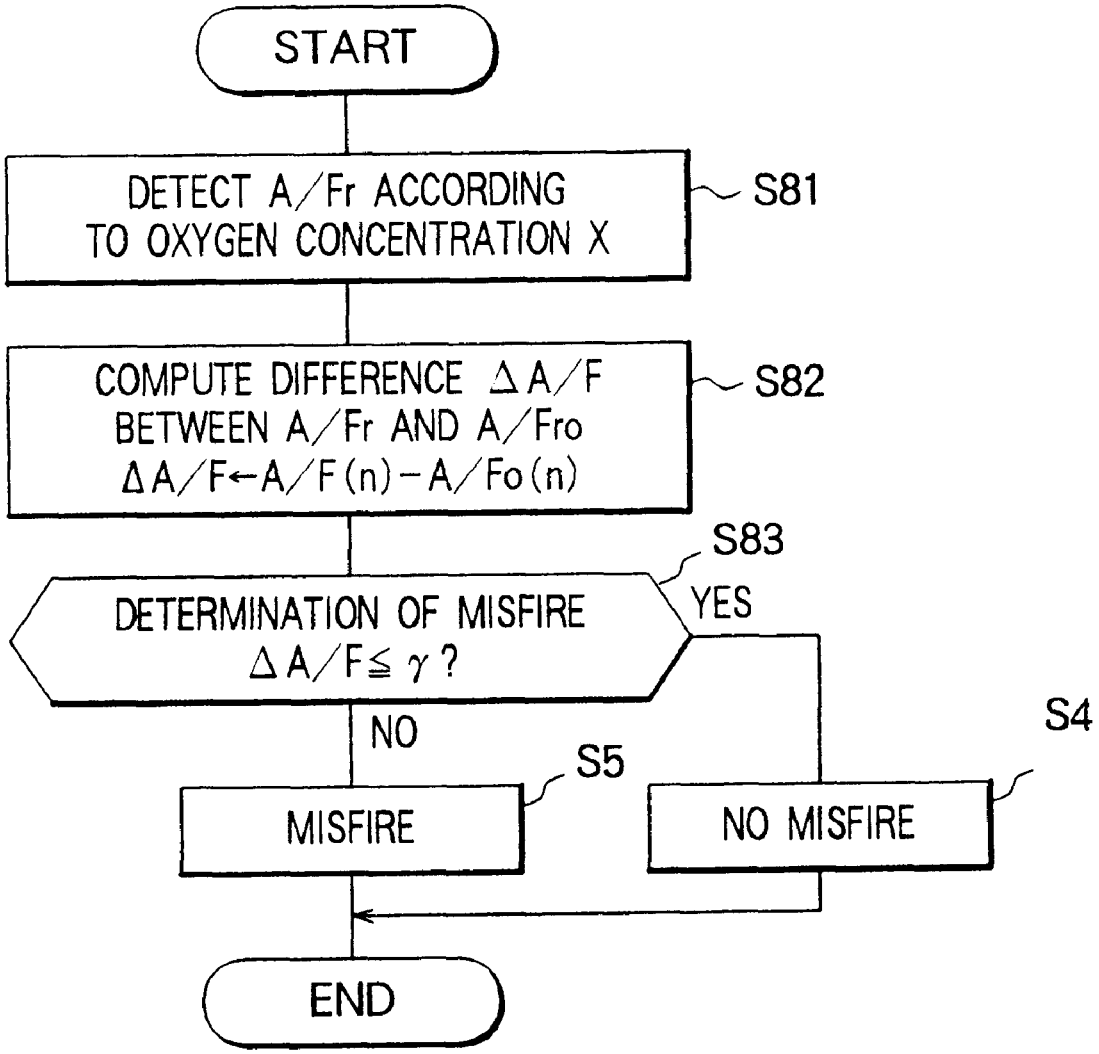
FIG. 20 is a flowchart illustrative of the processing for determining misfires by using an air/fuel ratio based on the concentration of oxygen in accordance with the seventh embodiment of the present invention.

FIG. 20 is a flowchart illustrating the misfire determination processing based on the actual air/fuel ratio A/Fr computed from the oxygen concentration X; steps S4 and S5 are the same steps as those previously described.

First, upon the occurrence of the interrupt of the falling edge of the crank angle signal SGT, the oxygen concentration X is detected and the actual air/fuel ratio A/Fr for each timing (n−5, n−4, . . . , n, n+1, . . . ) is computed (step S81).

At this time, there is a time lag from the moment the combustion takes place in a particular cylinder to the moment the oxygen concentration sensor 15 detects the exhaust gas of that particular cylinder.

For example, when cylinder #2 is ignited at time t13 (ignition timing IG (n−1)), the state of cylinder #2 is in the combustion stroke from time t13 to t14, and in the exhaust stroke from time t14 to t15; the combustion gas is exhausted from cylinder #2 during the period from time t14 to t15.

After that, during the period from time t15 to t16 in which the gas exhausted from cylinder #2 reaches the oxygen concentration sensor 15, the oxygen concentration sensor 15 detects the oxygen concentration X (n−1) in the exhaust gas and supplies the detection result to the CPU 31 in the electronic control unit 20.

After detecting the actual air/fuel ratio A/Fr from the oxygen concentration X, the CPU 31 computes the air/fuel ratio difference ΔA/F between the control target air/fuel ratio A/Fo and the actual air/fuel ratio A/Fr in step S82, then judges whether the computed air/fuel ratio difference ΔA/F is a predetermined value γ or less in step S83.

If $\Delta A/F \leqq \gamma$, that is, if the determination result is YES, then it means that the oxygen concentration X detected by the oxygen concentration sensor 15 is low and that much oxygen has been consumed in the combustion stroke, i.e. the combustion state is good.

Hence, the CPU proceeds to step S4 and decides that no misfire has taken place, then exits from the processing routine of FIG. 20.

If $\Delta A/F > \gamma$, i.e. if the determination result is NO, then it means that the oxygen concentration is high and that less oxygen has been consumed in the combustion stroke, i.e. the combustion state is not good.

Hence, the CPU proceeds to step S5 and decides that a misfire has occurred, then exits from the processing routine of FIG. 20.

Eighth Embodiment

In the seventh embodiment described above, the occurrence of misfires has been detected by the difference ΔA/F between the actual air/fuel ratio A/Fr and the target air/fuel ratio A/Fo which are based on the oxygen concentration X. As an alternative, however, intracylindrical pressure P detected by an intracylindrical pressure detecting unit 17 shown in FIG. 27 may be used to detect a misfire.

Figures 21A, 21B, 21C:
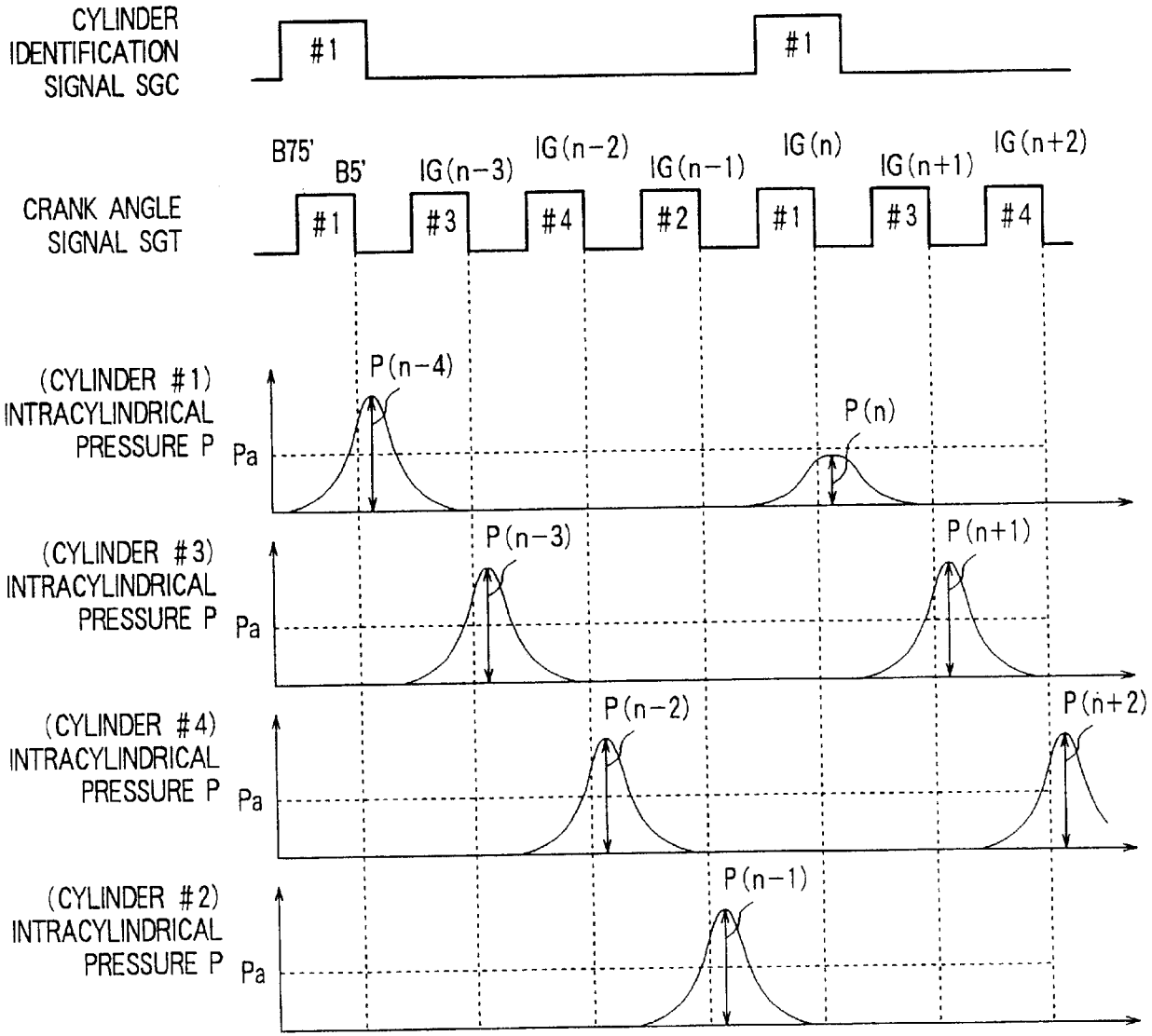
FIG. 21A through FIG. 21C are timing charts illustrative of a misfire determination processing operation based on an intracylindrical pressure in accordance with an eighth embodiment of the present invention.

FIG. 21A through FIG. 21C are timing charts illustrating the processing operation for detecting a misfire in the engine 1 according to the intracylindrical pressure P. FIGS. 21A and 21B show the same cylinder identification signal SGC and the crank angle signal SGT as those previously described, and FIG. 21C shows the time-dependent change in the intracylindrical pressure P in the compression stroke through the combustion stroke corresponding to the ignition timing for each cylinder.

In FIGS. 21A through 21C, P(i) (i=n−4, n−3, . . . , n, . . . , n+2) denotes the peak value of each intracylindrical pressure P.

Pa denotes the predetermined value which provides the misfire determining reference compared with the peak value P(i).

Figure 22:
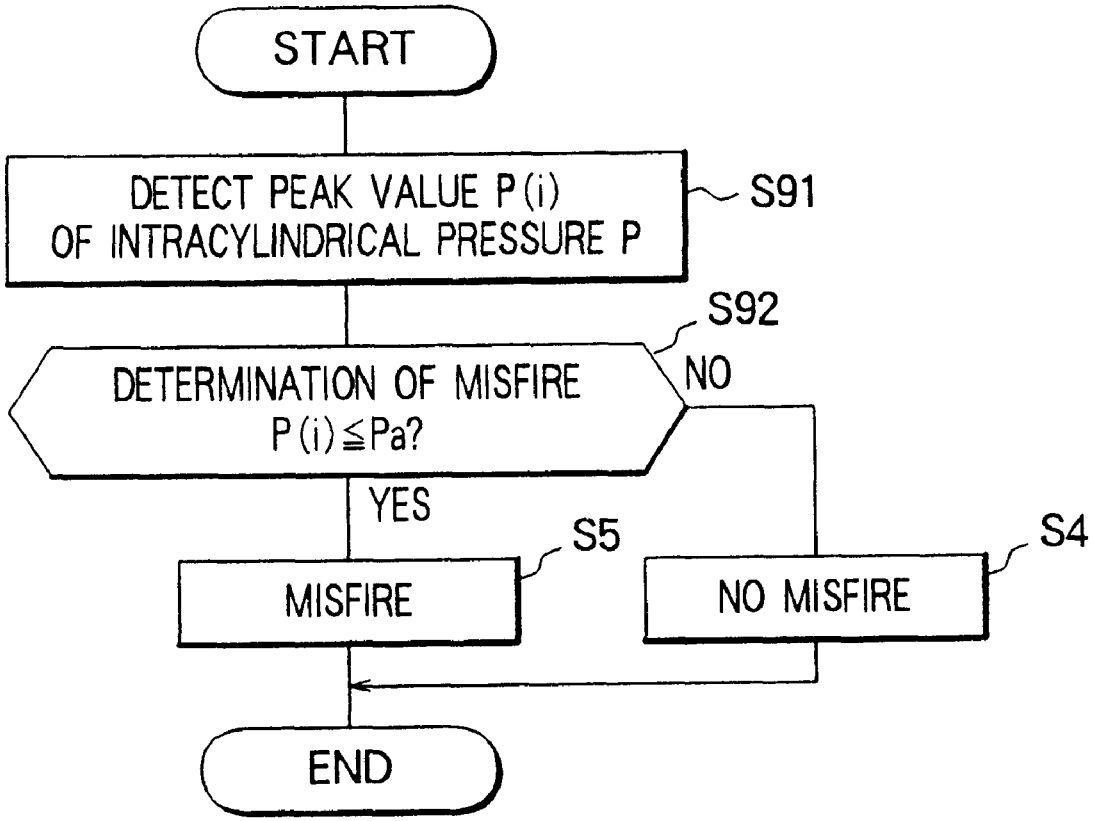
FIG. 22 is a flowchart illustrative of the misfire determination processing based on the intracylindrical pressure in accordance with the eighth embodiment of the present invention.

FIG. 22 is a flowchart illustrative of the misfire detecting processing in accordance with an eighth embodiment of the present invention. In FIG. 22, steps S4 and S5 are the same as those previously mentioned.

First, the peak value P(i) of the intracylindrical pressure P of the cylinder in the combustion stroke is detected in step S91.

In general, the intracylindrical pressure P depends on the motoring pressure which changes as the mixture in the cylinders 1*a* through 1*d* contracts or expands, and the combustion pressure produced when the fuel in the cylinders 1*a* through 1*d* is burnt; the motoring pressure remains almost constant under a predetermined operating condition.

Hence, the variation in the combustion pressure, i.e. the combustion state, of a cylinder under control can be detected by detecting the intracylindrical pressure P.

Then, the CPU determines whether the peak value P(i) of the intracylindrical pressure P is the predetermined value Pa or less in step S92, and if P(i)>Pa, i.e. if the determination result is NO, then it proceeds to step S4 wherein it decides that no misfire has taken place, and exits from the processing routine of FIG. 22.

If the CPU decides that $P(i) \leqq Pa$, that is, if the determination result is YES, then it proceeds to step S5 wherein it decides that a misfire has occurred, and exits from the processing routine of FIG. 22.

Ninth Embodiment

In the eighth embodiment described above, the occurrence of a misfire has been detected by the intracylindrical pressure P. Alternatively, however, misfires may be detected by knocking vibration K detected by a knocking sensor 18 shown in FIG. 27.

Figure 23:
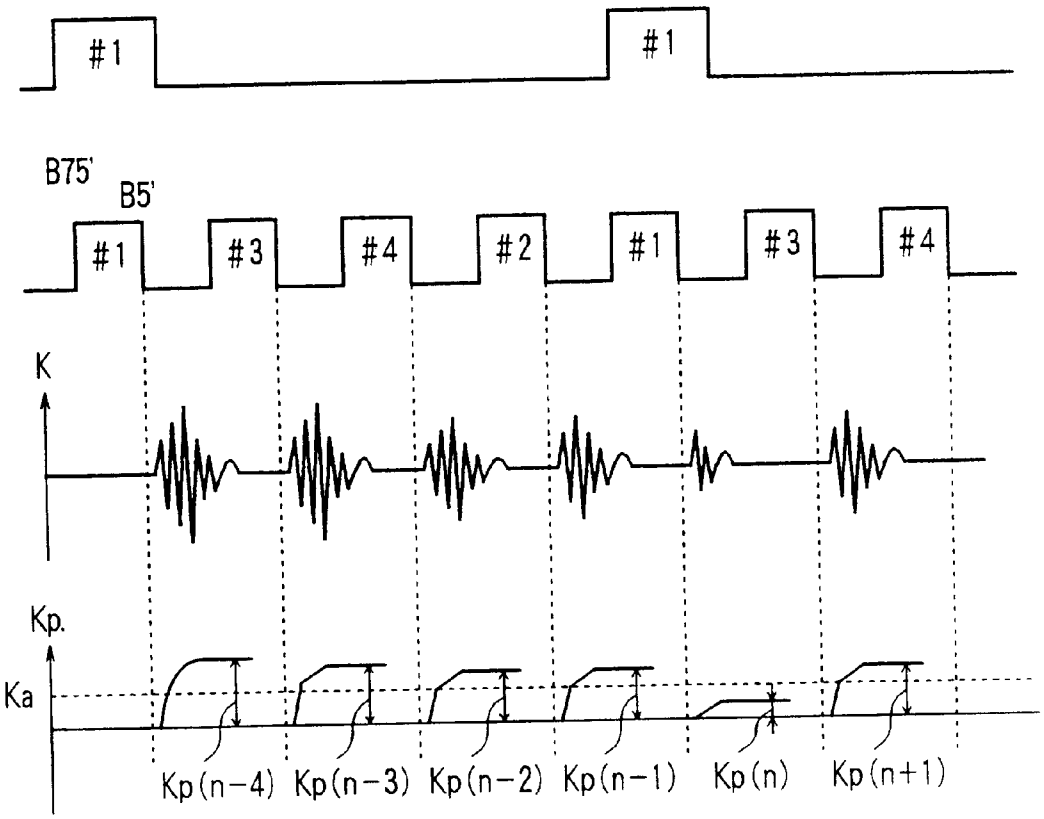
FIG. 23A through FIG. 23D are timing charts illustrative of a misfire determination processing operation based on knocking vibration in accordance with a ninth embodiment of the present invention.

FIG. 23A through FIG. 23D are timing charts illustrative of the misfire detection processing operation in accordance with a ninth embodiment. FIGS. 23A and 23B illustrate the same cylinder identification signal SGC and the crank angle signal SGT as those described above; FIG. 23C illustrates the knocking vibration K for each ignition timing of each cylinder; and FIG. 23D illustrates the time-dependent change in a peak hold value Kp(i) of the knocking vibration K.

In FIG. 23A through FIG. 23D, Ka denotes the predetermined value which provides the misfire determining reference compared with the peak hold value Kp(i).

Figure 24:
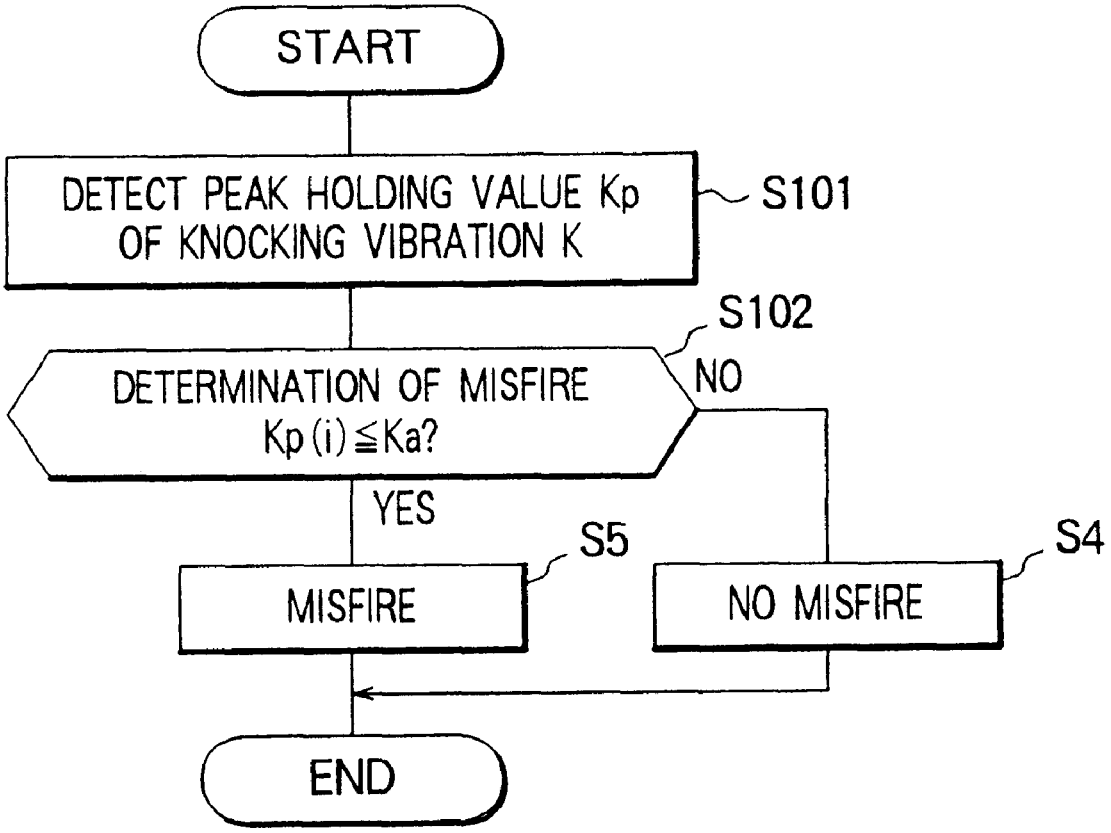
FIG. 24 is a flowchart illustrative of a misfire determination processing operation based on knocking vibration in accordance with a ninth embodiment of the present invention.

FIG. 24 is a flowchart showing the misfire detection processing in accordance with the ninth embodiment; steps S4 and S5 of FIG. 24 are the same as those previously described.

First, the knocking sensor 18 detects the knocking vibration K of the engine 1 produced when fuel is exploded in the combustion stroke in a cylinder going through the combustion stroke and supplies it to the CPU 31.

Thus, the CPU 31 detects the peak hold value Kp(i) of the knocking vibration K of a cylinder in the combustion stroke so as to judge the combustion state according to the knocking vibration K (step S91).

Next, the CPU 31 determines whether the peak hold value Kp(i) of the knocking vibration K is the predetermined value Ka or less in step S102, and if Kp(i)>Ka, i.e. if the determination result is NO, then it proceeds to step S4 wherein it decides that no misfire has occurred, and exits from the processing routine of FIG. 24.

If $Kp(i) \leqq Ka$, i.e. if the determination result is YES, then the CPU proceeds to step S5 wherein it decides that a misfire has occurred, and exits from the processing routine of FIG. 24.

In the embodiments described above, when the frequency of misfires Er increases, the frequency of misfires Er is reduced by executing a single misfire decreasing processing cycle; however, a plurality of arbitrary processing cycles may be combined instead.

Tenth Embodiment

In the embodiments described above, the processing for reducing the frequency of misfires Er is implemented after judging that the frequency of misfires Er has increased due to the deterioration in the combustion efficiency. As an alternative, however, if deterioration in the combustion efficiency is predicted from the duration of the compression stroke, the operational condition may be automatically changed.

Figures 25A, 25B:
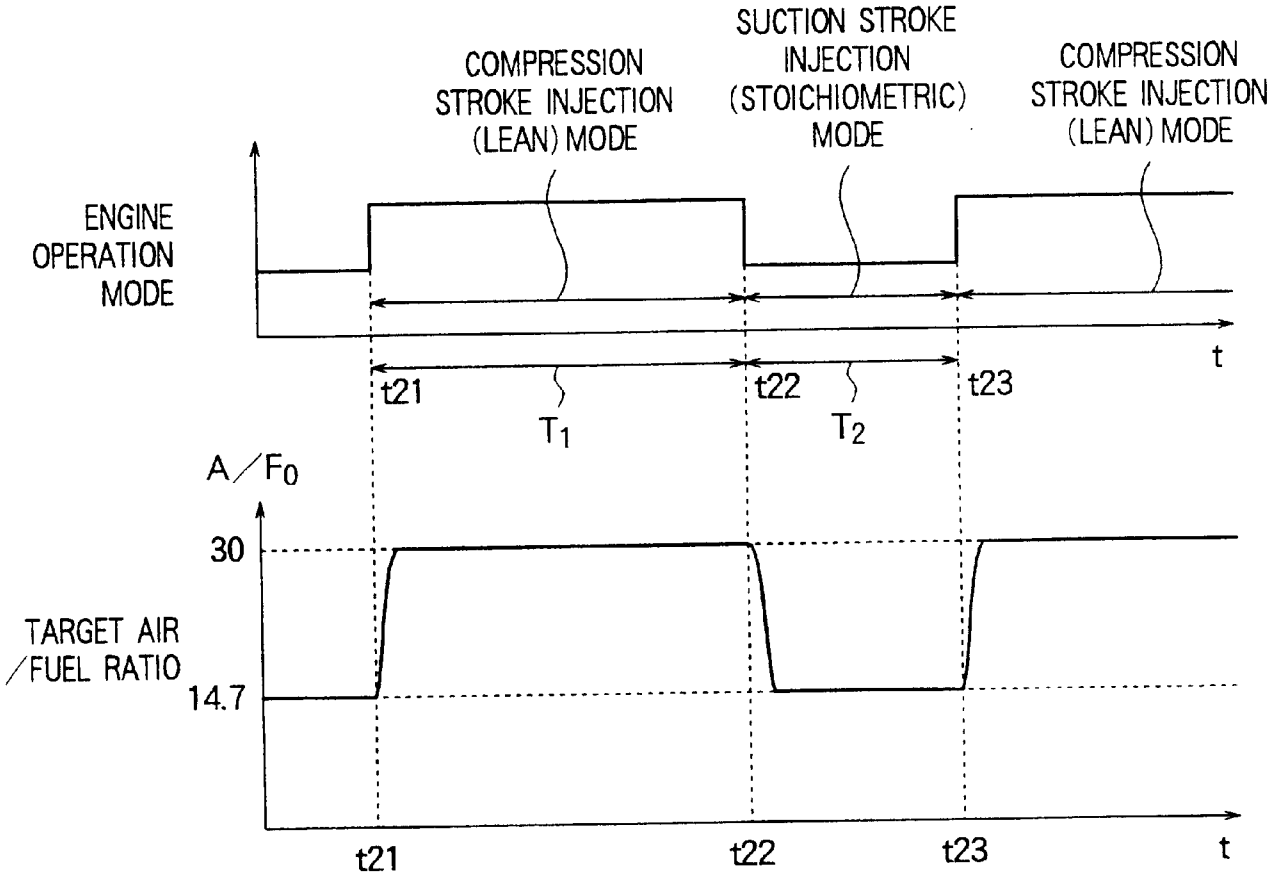
FIG. 25A and FIG. 25B are schematic representations illustrative of the processing operation for changing the fuel injection mode in accordance with a tenth embodiment of the present invention.

FIG. 25A and FIG. 25B are timing charts illustrating the changing processing operation in accordance with the tenth embodiment of the present invention; FIG. 25A shows the operation mode, i.e. the operation condition, of the engine 1, and FIG. 25B shows the time-dependent change in the control target air/fuel ratio A/Fo.

In FIGS. 25A and 25B, T1 denotes a predetermined time at which the combustion efficiency may deteriorate, and T2 denotes a predetermined time considered to be sufficient for the normal combustion efficiency to be recovered.

Figure 26:
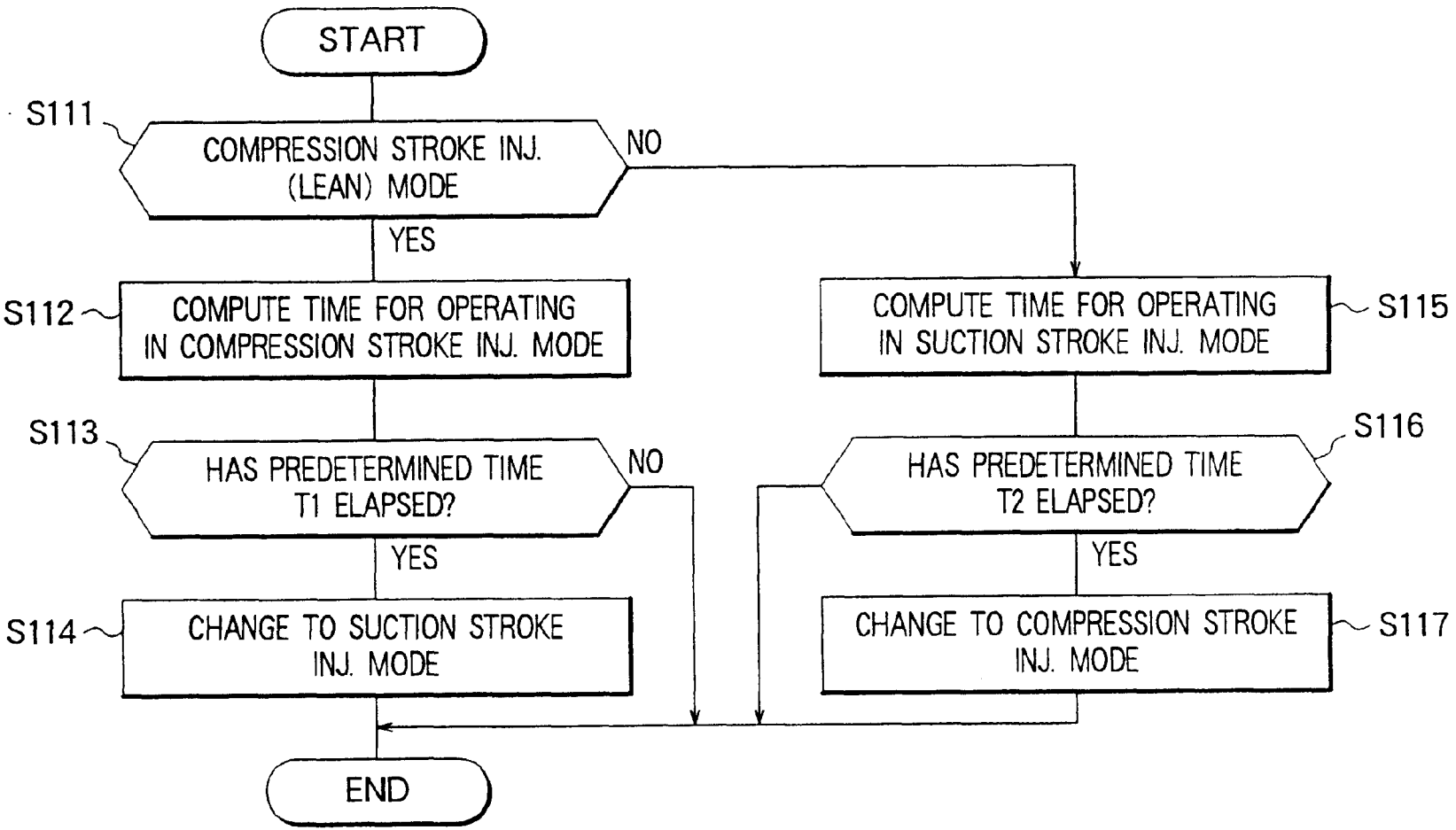
FIG. 26 is a flowchart illustrative of the processing operation for changing the fuel injection mode in accordance with the tenth embodiment of the present invention.

FIG. 26 is a flowchart illustrating the operating state changing processing in accordance with the tenth embodiment of the present invention. In FIG. 26, it is first determined whether the current operation mode of the engine 1 is the compression stroke injection mode, i.e. the lean mode (step S111).

If the current time is t12, it is determined that the operation mode of the engine 1 is the compression stroke injection mode, i.e. the determination result is YES, and the operating time in the compression stroke injection mode is computed in step S112.

Subsequently, it is determined in step S113 whether the compression stroke injection mode has lasted for the predetermined time T1, and if the determination result is NO, then the CPU exits from the processing routine of FIG. 26 without doing anything.

If it is determined at time t22 that the predetermined T1 has passed, that is, if the determination result is YES, then the CPU changes the operation mode of the engine 1 to the suction stroke injection mode in step S114 and exits from the processing routine of FIG. 26.

If the CPU decides in step S111 that the operation mode is the suction stroke injection mode, i.e. the stoichiometric mode, or the determination result is NO, then the CPU computes the operating time in the suction stroke injection mode in step S115 and determines in step S116 whether the suction stroke injection mode has lasted for the predetermined time T2.

If the duration of the suction stroke injection mode is below the predetermined time T2, that is, if the determination result is NO, then the CPU terminates the processing routine of FIG. 26. After that, at time t23, if the CPU determines that the predetermined time T2 has passed, that is, if the determination result is YES, then the CPU changes the operation mode to the compression stroke injection mode in step S117, and exits from the processing routine of FIG. 26.

In the tenth embodiment described above, the operation mode is changed to the suction stroke injection mode when the compression stroke injection mode has lasted for the predetermined time T1 or more. As in the case described above, however, the misfire reducing processing mentioned in any one of the third to fifth embodiments described above may be implemented if the compression stroke injection mode has lasted for the predetermined time T1 or more.

Thus, applying the means for restoring the normal combustion state according to the lasting time of the operation in the compression stroke injection mode obviates the need for providing a means for determining the combustion state of the engine 1, allowing the processing in the electronic control unit 20 to be simplified.

Furthermore, the normal combustion state is restored before the combustion state deteriorates rather than the recovering procedure of the normal combustion efficiency is started after an increase in the frequency of misfires Er has been detected. This makes it possible to prevent the combustion state from deteriorating, permitting the engine to be operated always in a good combustion state.

What is claimed is:

1. A control device for a cylinder injection internal-combustion engine comprising:

a fuel injection valve for directly injecting fuel into a cylinder of an internal-combustion engine;

an ignition coil unit for driving a spark plug in said cylinder;

an electronic control unit for driving said fuel injection valve and said ignition coil unit according to the operational state of said internal-combustion engine;

combustion state determining means for determining the combustion state of said internal-combustion engine; and combustion efficiency recovering means for recovering the combustion efficiency of said internal-combustion engine if it is determined that said combustion state has deteriorated.

2. A control device for a cylinder injection internal-combustion engine according to claim 1, wherein said combustion efficiency recovering means is constituted by injection mode changing means for changing said fuel injection mode from a compression stroke injection mode to a suction stroke injection mode.

3. A control device for a cylinder injection internal-combustion engine according to claim 2, wherein said injection mode changing means sets said fuel injection mode back to said compression stroke injection mode when said combustion state has been corrected.

4. A control device for a cylinder injection internal-combustion engine according to claim 3, wherein:

said combustion state determining means determines said combustion state again after setting said fuel injection mode back to said compression stroke injection mode; and said injection mode changing means switches said injection mode to said suction stroke injection mode again if it is determined that said combustion state has deteriorated again, or it maintains said injection mode in said compression stroke injection mode if no more deterioration of said combustion state is recognized.

5. A control device for a cylinder injection internal-combustion engine according to claim 4, wherein:

said combustion state determining means determines that the combustion state has deteriorated if the frequency of misfires has exceeded a first predetermined value in said compression stroke injection mode, and also determines that said combustion state has deteriorated again if the frequency of misfires has exceeded a second predetermined value which is smaller than said first predetermined value within a predetermined time from the moment at which the injection mode was set from said suction stroke injection mode back to said compression stroke injection mode.

6. A control device for a cylinder injection internal-combustion engine according to claim 1, wherein:

said combustion efficiency recovering means is composed of air/fuel ratio changing means for changing the air/fuel ratio of said internal-combustion engine to a rich mode.

7. A control device for a cylinder injection internal-combustion engine according to claim 6, wherein:

said air/fuel ratio changing means changes said air/fuel ratio to enrich a mixture only by a predetermined amount, and also changes said air/fuel ratio again to further enrich the mixture by said predetermined amount if said combustion state deteriorates again within a predetermined time after said air/fuel ratio has been changed.

8. A control device for a cylinder injection internal-combustion engine according to claim 6, wherein:

said air/fuel ratio changing means sets said air/fuel ratio back to a lean mode as soon as said combustion state is recovered.

9. A control device for a cylinder injection internal-combustion engine according to claim 8, wherein:

said combustion state determining means checks said combustion state again after setting said air/fuel ratio back to the lean mode; and said air/fuel ratio changing means changes said air/fuel ratio again to the rich mode if it determines that said combustion state has deteriorated again, or if no deterioration of said combustion state is recognized any more, then it maintains said air/fuel ratio in the lean mode.

10. A control device for a cylinder injection internal-combustion engine according to claim 9, wherein:

said combustion state determining means determines that said combustion state has deteriorated if the frequency of misfires has exceeded a first predetermined value in the lean mode of said air/fuel ratio, and also determines that said combustion state has deteriorated again if the frequency of misfires has exceeded a second predetermined value which is smaller than said first predetermined value within a predetermined time from the moment said rich mode has been set back to said lean mode.

11. A control device for a cylinder injection internal-combustion engine according to claim 1, wherein said combustion efficiency recovering means is composed of ignition control changing means for applying said ignition signal also to the ignition coil unit of a cylinder in addition to a cylinder under ignition control.

12. A control device for a cylinder injection internal-combustion engine according to claim 11, wherein said ignition control changing means sets said ignition signal back to its normal state when said combustion state has been restored.

13. A control device for a cylinder injection internal-combustion engine according to claim 12, said combustion state determining means checks said combustion state again after setting said ignition signal back to the normal mode, and if it is determines that said combustion state has deteriorated again, then said ignition control changing means applies said ignition signal again to the ignition coil unit of a cylinder in addition to the cylinder under said ignition control, or if no deterioration of said combustion state is recognized any more, then it maintains said ignition signal in the normal mode.

14. A control device for a cylinder injection internal-combustion engine according to claim 13, wherein said combustion state determining means;

determines that said combustion state has deteriorated if the frequency of misfires has exceeded a first predetermined value in the normal ignition signal state of said ignition signal, and also determines that said combustion state has deteriorated again if the frequency of misfires has exceeded a second predetermined value which is smaller than said first predetermined value within a predetermined time from the moment said ignition signal has been set back to the normal state.

15. A control device for a cylinder injection internal-combustion engine according to claim 1, wherein said combustion efficiency recovering means is constituted by a control timing changing means for changing at least one of a fuel injection timing based on said injection signal and an ignition timing based on said ignition signal.

16. A control device for a cylinder injection internal-combustion engine according to claim 15, wherein said control timing changing means sets said injection signal and said ignition signal back to the normal state thereof when said combustion state has been restored.

17. A control device for a cylinder injection internal-combustion engine according to claim 16, wherein:

said combustion state determining means judges said combustion state again after setting said control timing back to the normal state; and if it is determined that said combustion state has been deteriorated again, then said control timing changing means changes said control timing again, or if no deterioration of said combustion state is detected any more, then said control timing changing means maintains said control timing in the normal state.

18. A control device for a cylinder injection internal-combustion engine according to claim 17, wherein said combustion state determining means determines that said combustion state has deteriorated if the frequency of misfires has exceeded a first predetermined value in the normal state of said control timing; and also determines that said combustion state has deteriorated again if the frequency of misfires has exceeded a second predetermined value which is smaller than said first predetermined value within a predetermined time from the moment said control timing was reset to the normal state.

19. A control device for a cylinder injection internal-combustion engine according to any one of claim 1, comprising at least one of a rotational change detecting means for detecting a change in the revolution of said internal-combustion engine, an ionic current detecting unit for detecting ionic current from each of said cylinders, an air/fuel ratio difference detecting means for detecting the difference between an actual air/fuel ratio and a target air/fuel ratio according to the oxygen concentration of exhaust gas discharged from each of said cylinder, and an intracylindrical pressure detecting unit for detecting the intracylindrical pressure of each of said cylinders; wherein said combustion state determining means determines that said combustion state has deteriorated when it detects at least one of a change in the revolution of a predetermined value or more, an ionic current of a predetermined value or less, an air/fuel ratio difference of a predetermined value or more, and an intracylindrical pressure of a predetermined value or more.

20. A control device for a cylinder injection internal-combustion engine comprising:

a fuel injection valve for directly injecting fuel into each cylinder of said internal-combustion engine;

an ignition coil unit for driving a spark plug in each cylinder;

an electronic control unit for driving said each fuel injection valve and said ignition coil unit according to the operational state of said internal-combustion engine;

elapsed time determining means for determining whether the operation in a compression stroke injection mode has lasted for a predetermined time for which the deterioration of the combustion state can happen; and combustion efficiency recovering means for restoring the combustion efficiency of said internal-combustion engine;

wherein said combustion efficiency recovering means is constituted at least by:

injection mode changing means for changing the injection state of fuel from the compression stroke injection mode to a suction stroke injection mode;

air/fuel ratio changing means for changing the air/fuel ratio of said internal-combustion engine to a rich mode;

ignition control changing means for applying an ignition signal also to an ignition coil unit of a cylinder in addition to a cylinder under ignition control; and control timing changing means for changing at least one of the fuel injection timing based on an injection signal and the ignition timing based on an ignition signal.

* * * * *